US010625902B2

(12) United States Patent
Morcos

(10) Patent No.: US 10,625,902 B2
(45) Date of Patent: Apr. 21, 2020

(54) CONTAINER ASSEMBLY

(71) Applicant: Samir Morcos, Pasadena, CA (US)

(72) Inventor: Samir Morcos, Pasadena, CA (US)

( * ) Notice: Subject to any disclaimer, the term of this patent is extended or adjusted under 35 U.S.C. 154(b) by 0 days.

(21) Appl. No.: 16/128,400

(22) Filed: Sep. 11, 2018

(65) Prior Publication Data

US 2020/0079552 A1 Mar. 12, 2020

(51) Int. Cl.

| | |
|---|---|
| ***B65D 30/10*** | (2006.01) |
| ***B65D 21/08*** | (2006.01) |
| ***B65D 25/28*** | (2006.01) |
| ***B65D 25/04*** | (2006.01) |

(52) U.S. Cl.

CPC ..... *B65D 21/086* (2013.01); *B65D 25/04* (2013.01); *B65D 25/28* (2013.01); *B65D 2525/287* (2013.01)

(58) Field of Classification Search

CPC ..... B65D 21/086; B65D 25/04; B65D 25/28; B65D 2525/287; A47D 9/005

USPC ..... 220/9.2, 9.3, 485

See application file for complete search history.

(56) References Cited

U.S. PATENT DOCUMENTS 1,119,429 A * 12/1914 Jetter ..... B65D 37/00 220/9.3

2016/0338506 A1* 11/2016 Yang ..... A47D 9/005

* cited by examiner

*Primary Examiner* — King M Chu

(74) *Attorney, Agent, or Firm* — Law Office of Michael O'Brien; Michael O'Brien; Jack Fritz

(57) ABSTRACT

A collapsible support structure can be used with a container assembly. The collapsible support structure includes four corner connectors rotationally connected to one another with connector plates and a locking mechanism. A leg attached to each of the four corner connectors by a vertical tube. All legs are rotationally connected to a central support assembly which can rotate around a vertical axis.

8 Claims, 25 Drawing Sheets

FIG. 37
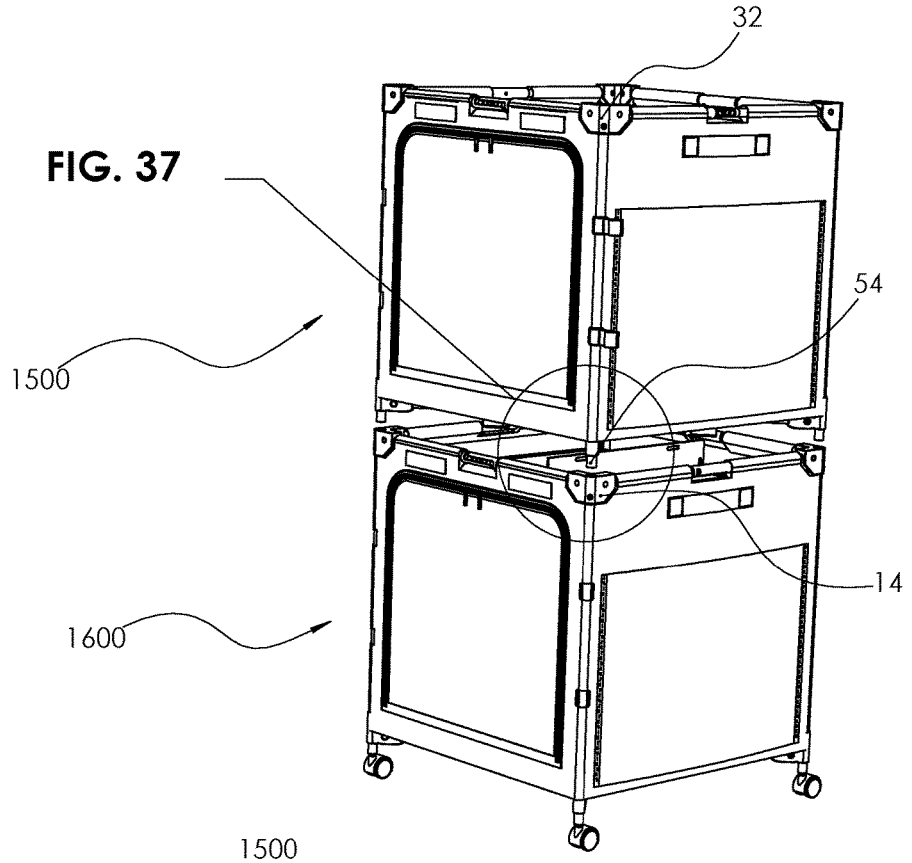
FIG. 36
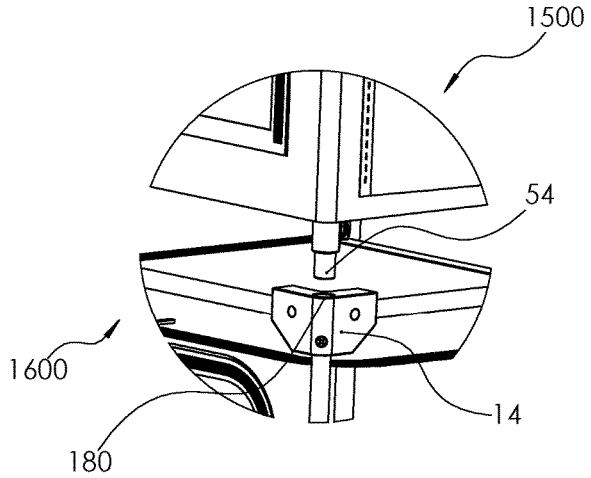
FIG. 37

CONTAINER ASSEMBLY

BACKGROUND

The embodiments herein relate generally to containers.

Prior to embodiments of the disclosed invention, there was not a reliable, collapsible storage and transportation system. Embodiments of the disclosed invention solve that problem.

SUMMARY

A collapsible support structure can be used with a container assembly. The collapsible support structure includes four upper corner connectors rotationally connected to one another with connector tubes. A lower corner leg, attached to each of the upper corner connectors and to a slider. A central support assembly that is rotationally connected to all of the sliders.

BRIEF DESCRIPTION OF THE FIGURES

The detailed description of some embodiments of the invention is made below with reference to the accompanying figures, wherein like numerals represent corresponding parts of the figures.

FIGS. 26A and 26B shows a perspective view of one embodiment of a collapsible support structure with first base support of the present invention.

FIG. 36 shows a perspective view of vertical stacking of two embodiments base assembly design of the present invention.

FIG. 37 shows a detail view of vertical stacking of two embodiments base assembly design of the present invention.

DETAILED DESCRIPTION OF CERTAIN EMBODIMENTS

Figure 1A:
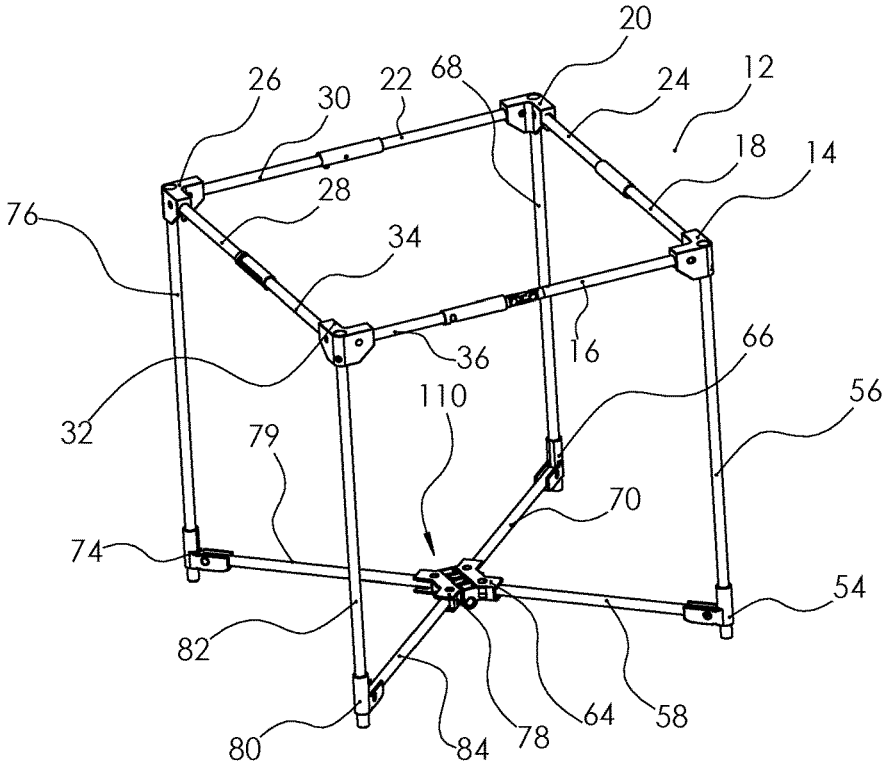
FIG. 1A and FIG. 1B shows a perspective view of one embodiment of a collapsible support structure of the present invention.
Figure 1B:
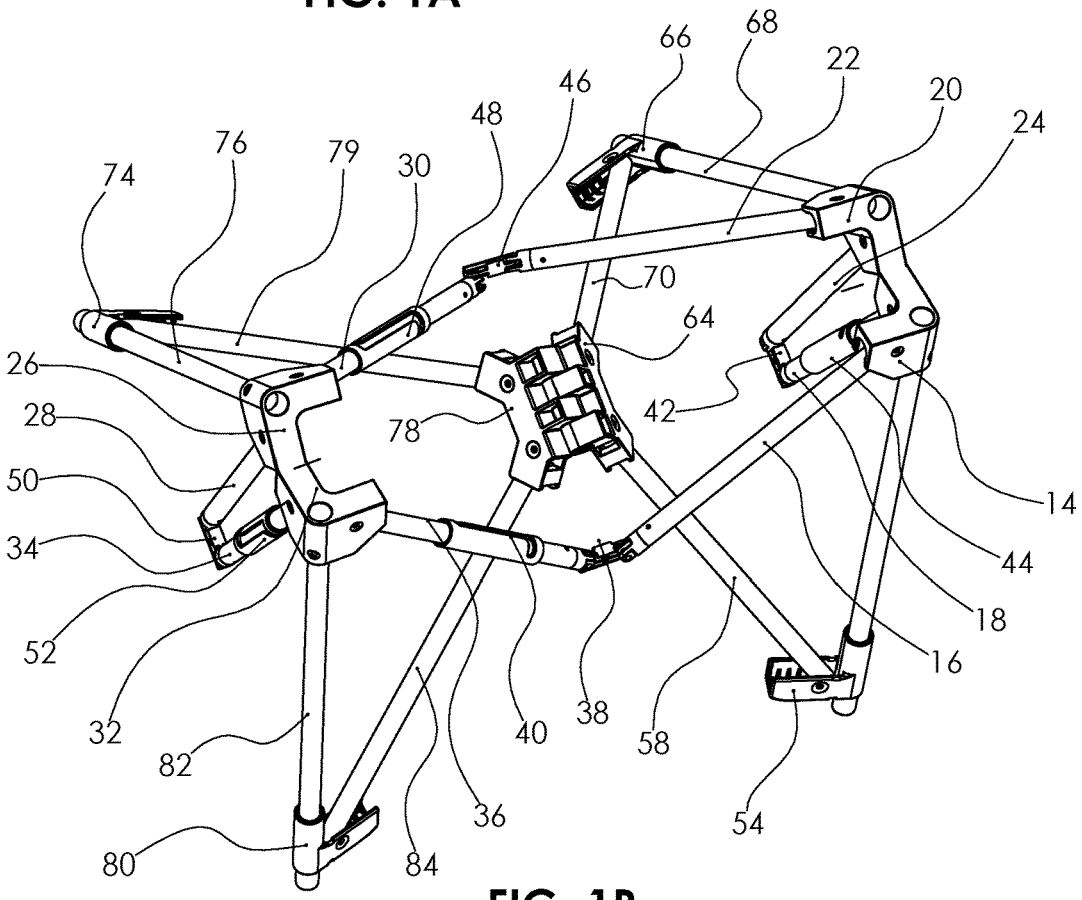
Figure 2:
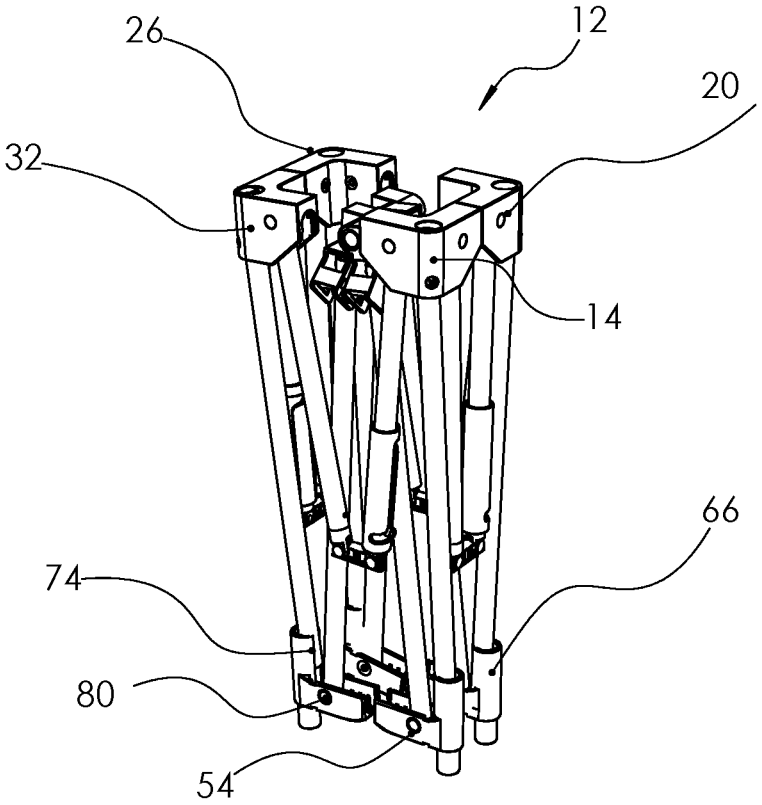
FIG. 2 shows a perspective view of one embodiment of a collapsible support structure of the present invention.
Figure 3:
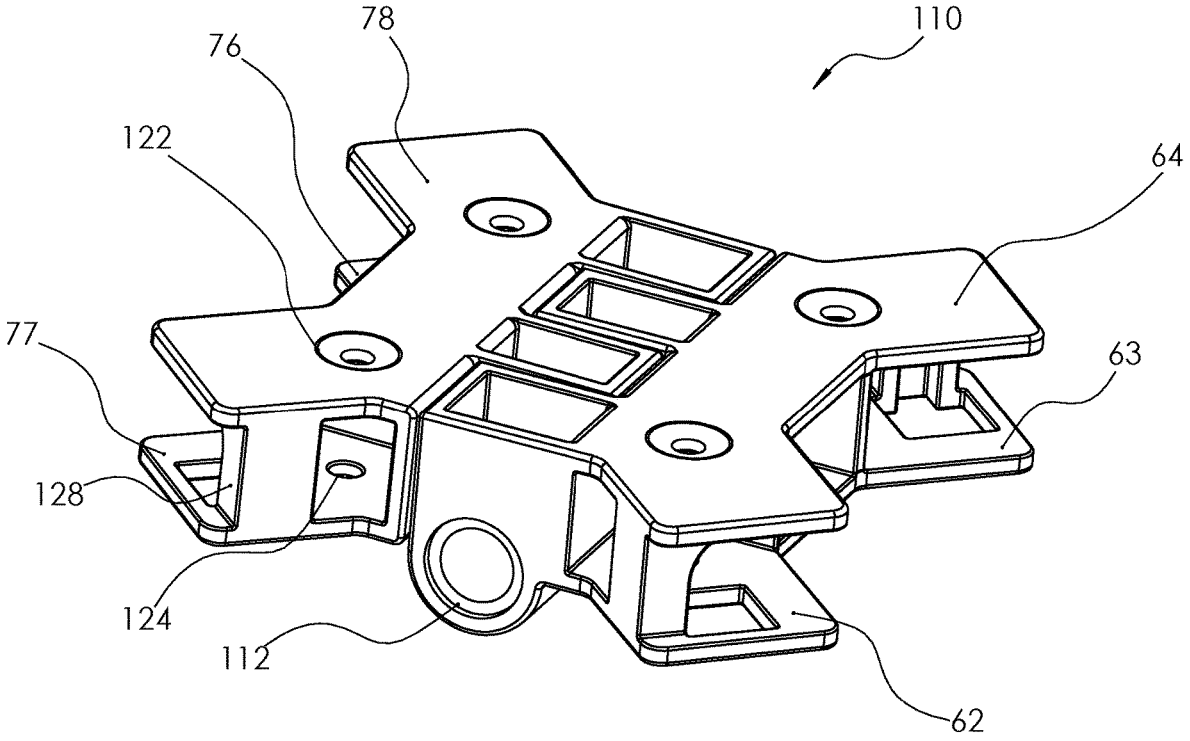
FIG. 3 shows a perspective view of one embodiment of a central support assembly of the present invention.
Figure 4:
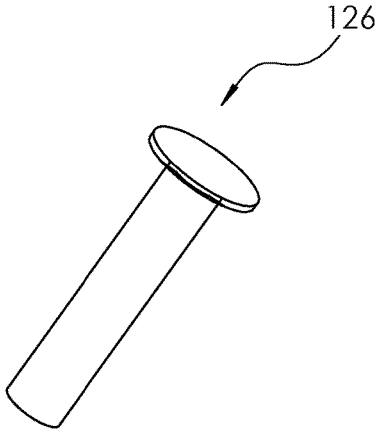
FIG. 4 shows a perspective view of one embodiment of a rivet for use in a central support assembly of the present invention.
Figure 6:
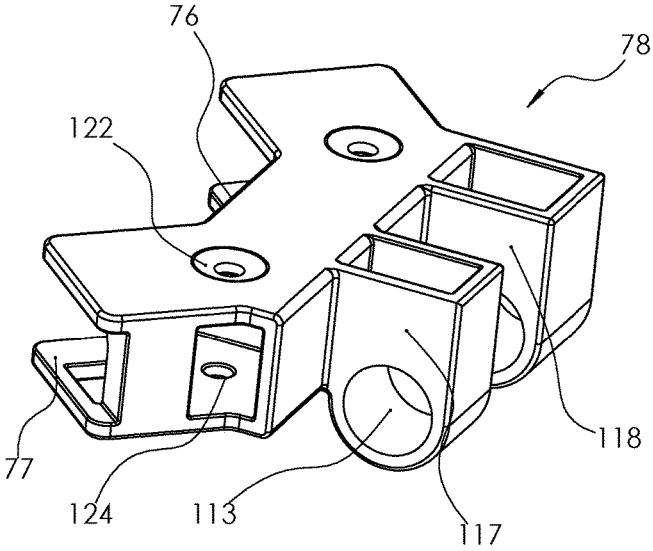
FIG. 6 shows a perspective view of one embodiment of a second central support assembly of the present invention.
Figure 5:
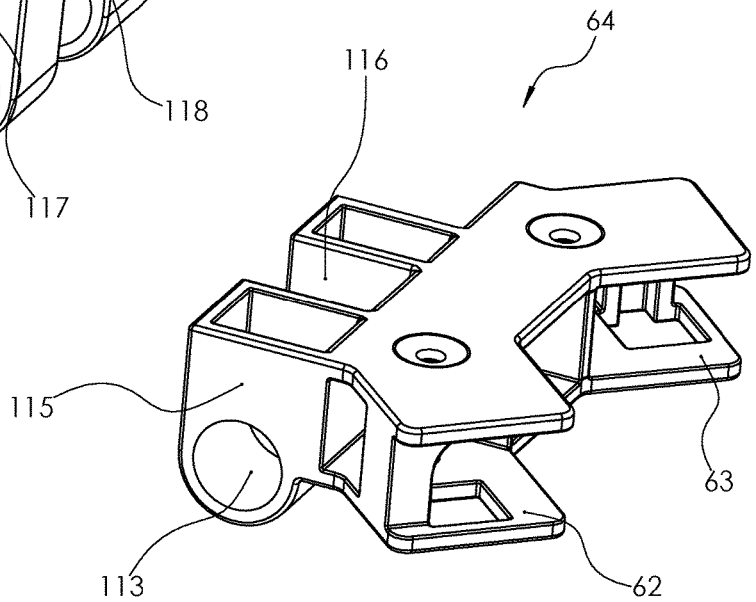
FIG. 5 shows a perspective view of one embodiment of a first central support assembly of the present invention.
Figure 7:
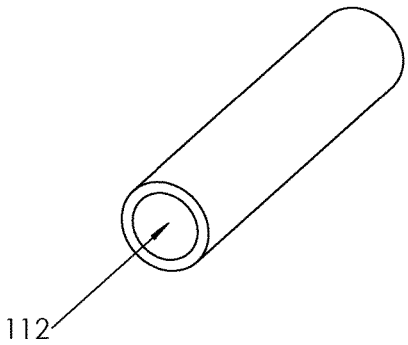
FIG. 7 shows a perspective view of one embodiment of a pin for use in a central support assembly of the present invention.
Figure 8:
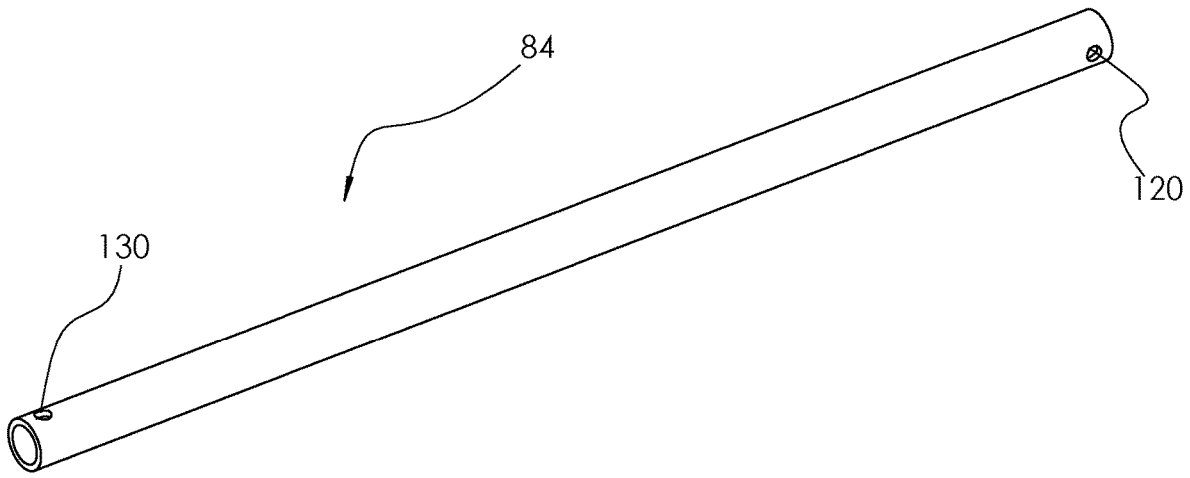
FIG. 8 shows a perspective view of one embodiment of a central support Lower tube member of the present invention.

By way of example, and referring to FIGS. 1A-2, and FIG. 27, one embodiment a container assembly 10 further comprises a collapsible support structure 12. The collapsible support structure 12 further comprises a first corner connector 14. The first corner connector 14 is rotationally attached to a first corner first arm 16 and a first corner second arm 18.

The second corner connector 20 is rotationally attached to a second corner first arm 24 and a second corner second arm 22. The third corner connector 26 is rotationally attached to a third corner first arm 30 and a third corner second arm 28. The fourth corner connector 32 is rotationally attached to a fourth corner first arm 34 and a fourth corner second arm 36.

The first corner first arm 16 is rotationally connected to a first connecting plate 38 which is further rotationally connected to the fourth corner second arm 36. A first arm locking tube 40 can be slid over the first connecting plate 38 to rigidly join the first corner first arm 16 to the fourth corner second arm 36.

The first corner second arm 18 is rotationally connected to a second connecting plate 42 which is further rotationally connected to the second corner first arm 24. A second arm locking tube 44 can be slid over the second connecting plate 42 to rigidly join the first corner second arm 18 to the second corner first arm 24.

The second corner second arm 22 is rotationally connected to a third connecting plate 46 which is further rotationally connected to the third corner first arm 30. A third arm locking tube 48 can be slid over the third connecting plate 46 to rigidly join the second corner second arm 22 to the third corner first arm 30.

The third corner second arm 28 is rotationally connected to a fourth connecting plate 50 which is further rotationally connected to the fourth corner first arm 34. A fourth arm locking tube 52 can be slid over the fourth connecting plate 50 to rigidly join the third corner second arm 28 to the fourth corner first arm 34.

In FIG. 1-6, a first leg 54 connect along a first vertical arm 56 that is rigidly attached to the first corner connector 14. A first leg lower arm 58 is rotationally connected to the first leg 54 and a first central support 64 first opening 62.

A second leg 66 connect along a second vertical arm 68 that is rigidly attached to the second corner connector 20. A second leg lower arm 70 is rotationally connected to the second leg 66 and the first central support 64 second opening 63.

A third leg 74 connect along a third vertical arm 76 that is rigidly attached to the third corner connector 26. A third lower arm 79 is rotationally connected to the third leg 74 and the second central support 78 first opening 76.

A fourth leg 80 connect along a fourth vertical arm 82 that is rigidly attached to the fourth corner connector 32. A fourth lower arm 84 is rotationally connected to the fourth leg 80 and the second central support 78 opening 77.

Turning to FIGS. 3-9, a central support assembly 110 further comprises the first central support member 64 rotationally joined to the second central support member 78 with a pin 112. The first central support 64 further comprises a first central support first knuckle 115 and a first central support second knuckle 116 which can accommodate the pin 112 through opening 113. The second central support member 78 further comprises a second central support first knuckle 117 and a second central support second knuckle 118 which can accommodate the pin 112 through opening 113.

The second central support member 78 further comprises a fourth central support lower arm 84 first opening 120. The fourth central support lower arm first opening 120 is aligned with the second central support member 78 upper opening 122 and the second central support member 78 lower opening 124. A rivet 126 can be inserted through the second central support member 78 upper opening 122 through the fourth central support lower arm 84 first opening 120, and through the second central support member 78 lower opening 124 to horizontally join and rotate the fourth central support lower arm 84 to the central support assembly 110. However, this rotation can be restricted, a central support assembly side wall 128 can be arranged to limit the rotational movement of the fourth central support lower tube 84.

FIG. 8-11 The fourth lower arm 84 further comprises second opening 130 to align with a fourth leg 80 first opening 132 and second opening 134. A rivet 126 can be inserted through the fourth leg 80 first opening 132 through the fourth leg lower arm 84 second opening 130 through the fourth leg second opening 134 to vertically join and rotate the fourth leg lower arm 84 to the fourth leg 80. However, this rotation can be restricted, a fourth leg slider opening wall 136 can be arranged to restrict movement.

The fourth leg 80 can further comprise a fourth vertical tube 82 that can slide down inside the fourth leg 80 opening 138 and can be limited travel by fourth leg rib 139 to increase structural support.

Figure 23:
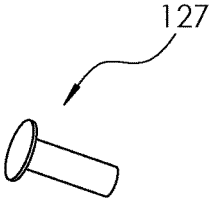
FIG. 23 shows a perspective view of one embodiment of a rivet of the present invention.

Turning to FIGS. 12-18 The first corner first connecting hinge 142 shaft 144 is comprised inside the first corner first arm 16 first opening 138. Aligning opening 138 in the first corner first arm 16 to opening 146 in the first corner first connecting top hinge 142. Insert pin 166 through opening 138 in first corner first arm 16 through opening 146 in first corner first connecting hinge 142 to rigidly join the first corner first arm 16 to the first corner first connecting hinge 142. The first corner first connecting plate 38 surface 918 is comprise in-between the two surfaces 148 and 154 in first corner first connecting top hinge 142. Align opening 158 in the first corner first connecting plate 38 to openings 150 and opening 152 in the first corner first connecting top hinge 142. Insert rivet 127 FIG. 23 through opening 150 in the first corner first connecting top hinge 142 through opening 158 in the first corner first connecting plate 38 through opening 152 in the first corner first connecting top hinge 142 to rotationally join the first corner first connecting top hinge 142 to the first corner first connecting plate 38.

The fourth corner second connecting top hinge 142 shaft 144 is comprised inside the fourth corner second arm 36 first opening 140. Aligning the fourth corner second arm 36 first opening 140 to the fourth corner second connecting top hinge 142 opening 146. Insert pin 166 through opening 140 in fourth corner second arm 36 through opening 146 in fourth corner connecting top hinge 142 to rigidly join the fourth corner second arm 36 to the first corner first connecting hinge 142. The fourth corner second connecting plate 38 surface 919 is comprise in-between the two surfaces 148 and 154 in connecting top hinge 142. Align opening 156 in fourth corner second connecting plate 38 to openings 152 and opening 150 in the fourth corner second connecting top hinge 142. Insert rivet 127 through opening 152 in the fourth corner second connecting top hinge 142 through opening 156 in the fourth corner second connecting plate 38 through opening 150 in the fourth corner second connecting top hinge 142 to rotationally join the fourth corner second connecting hinge 142 to the fourth corner second connecting plate 38.

The first arm locking tube 40 further comprises a first arm locking tube longitudinal slot 194 which terminates in a first arm locking tube proximal slot 196 and a first arm tube distal slot 198. A protrusion of pin 166 in the first corner first arm 16 first opening 138 can be used in the first arm locking tube longitudinal slot 194 to hold the first arm locking tube 40 in place. The first locking tube 40 moves over and lock in place the fourth corner second arm 36 with the fourth corner connecting hinge 142 with the connecting plate 38 with the first corner first top hinge 142 with the first corner first arm 16 all locked together in place.

Turning to FIGS. 19-23 The fourth corner connector 32 further comprises a fourth corner second arm 36 opening 138 to align with the fourth corner connector 32 openings 178 and opening 186. Rivet 126 is inserted to the fourth corner connector opening 186 through the fourth corner second arm 36 opening 138 through the forth corner connector 32 opening 178 which can be rotationally connected with rivet 126. This rotational movement can be limited by a fourth corner second arm wall 182 arranged within the fourth corner connector 32.

The fourth corner connector 32 further comprises a fourth corner first arm 34 opening 138 to align with the fourth corner connector 32 opening 180 and opening 184. Rivet 126 is inserted to the fourth corner connector opening 180 through the fourth corner first arm 34 opening 138 through the fourth corner connector 32 opening 184 which can be rotationally connected with rivet 126. This rotational movement can be limited by a fourth corner first arm wall 188 arranged within the fourth corner connector 32.

Figure 9:
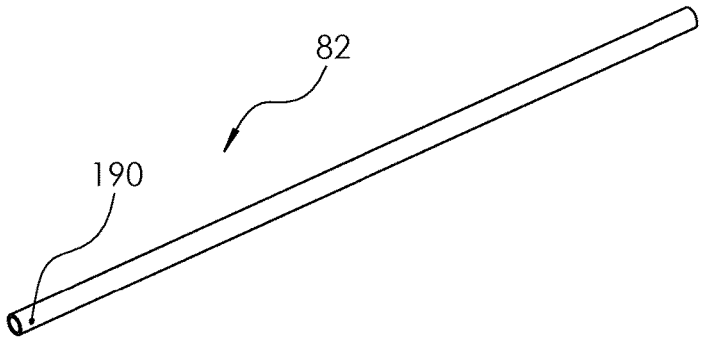
FIG. 9 shows a perspective view of one embodiment of a leg vertical tube of the present invention.
Figure 10:
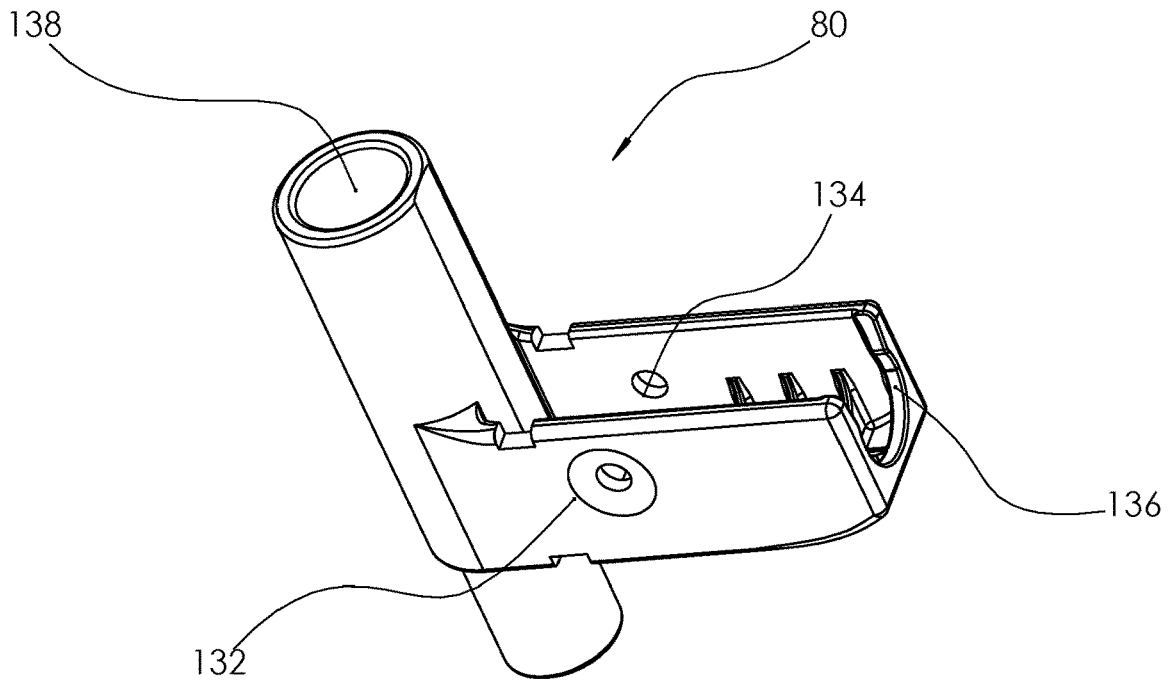
FIG. 10 shows a perspective view of one embodiment of a lower rotating corner and leg of the present invention.
Figure 11:
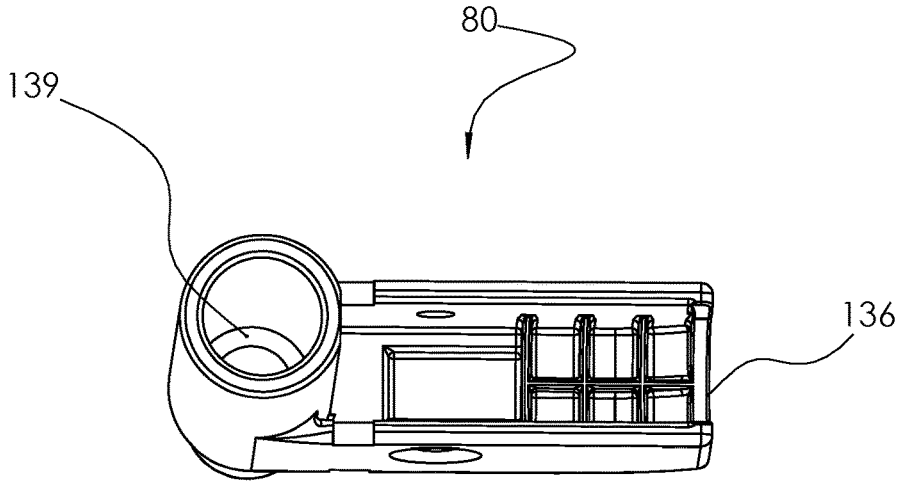
FIG. 11 shows a top view of one embodiment of a lower rotating corner and leg of the present invention.
Figure 12:
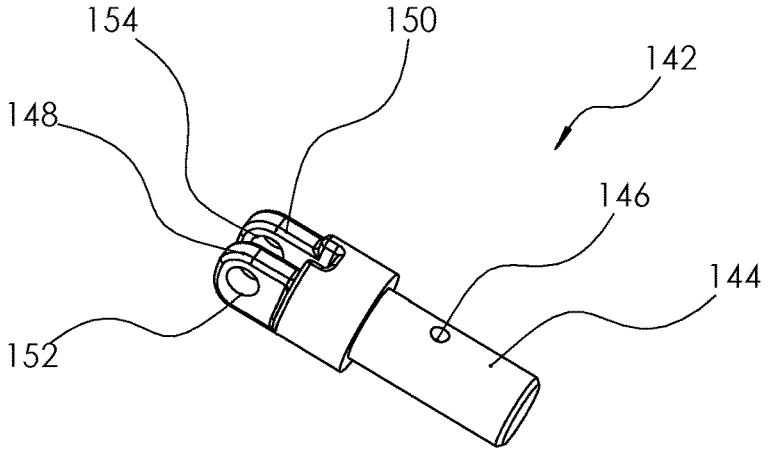
FIG. 12 shows a perspective view of one embodiment of a connecting top hinge of the present invention.
Figure 13:
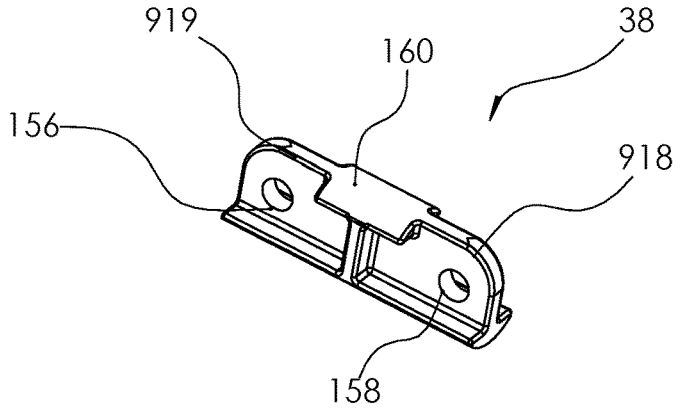
FIG. 13 shows a perspective view of one embodiment of a connecting plate of the present invention.
Figure 14:
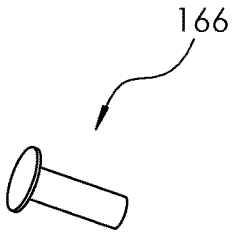
FIG. 14 shows a perspective view of one embodiment of a pin of the present invention.
Figure 15:
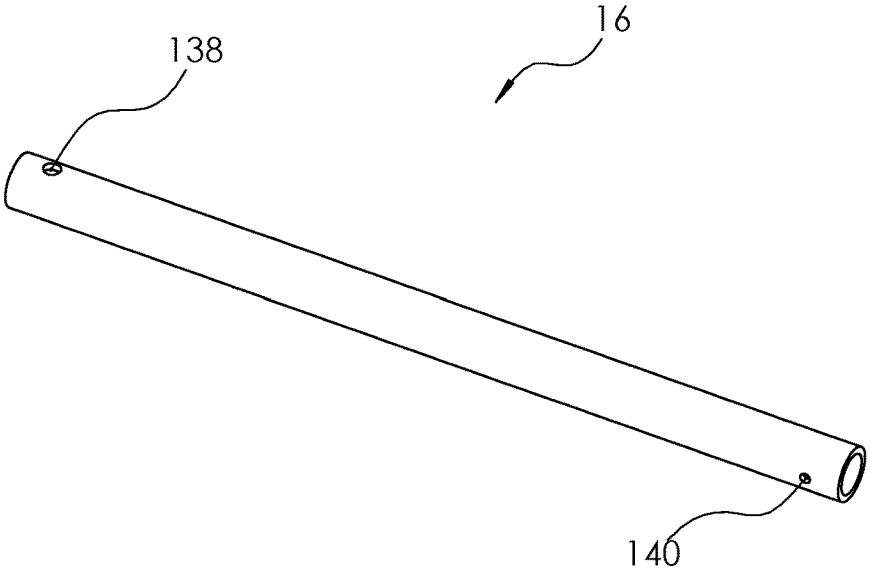
FIG. 15 shows a perspective view of one embodiment of a upper corner connecting tube of the present invention.
Figure 16:
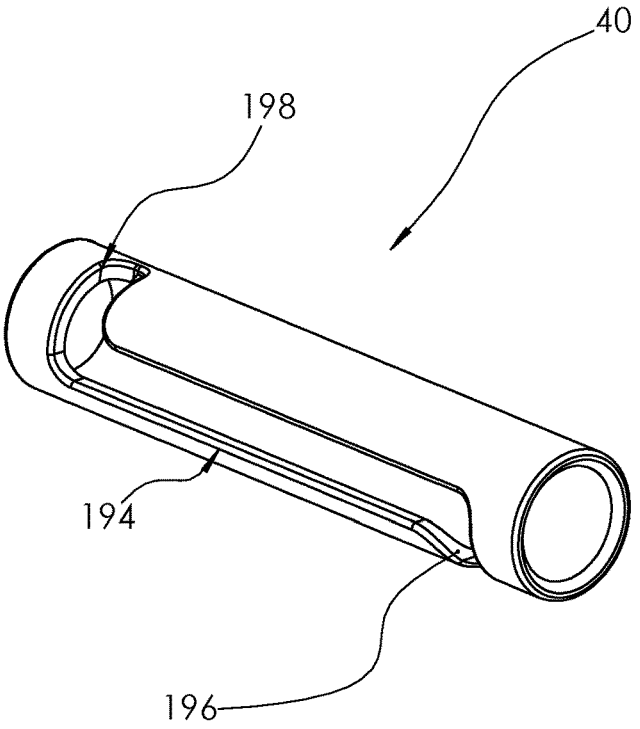
FIG. 16 shows a perspective view of one embodiment of a locking tube of the present invention.
Figure 17:
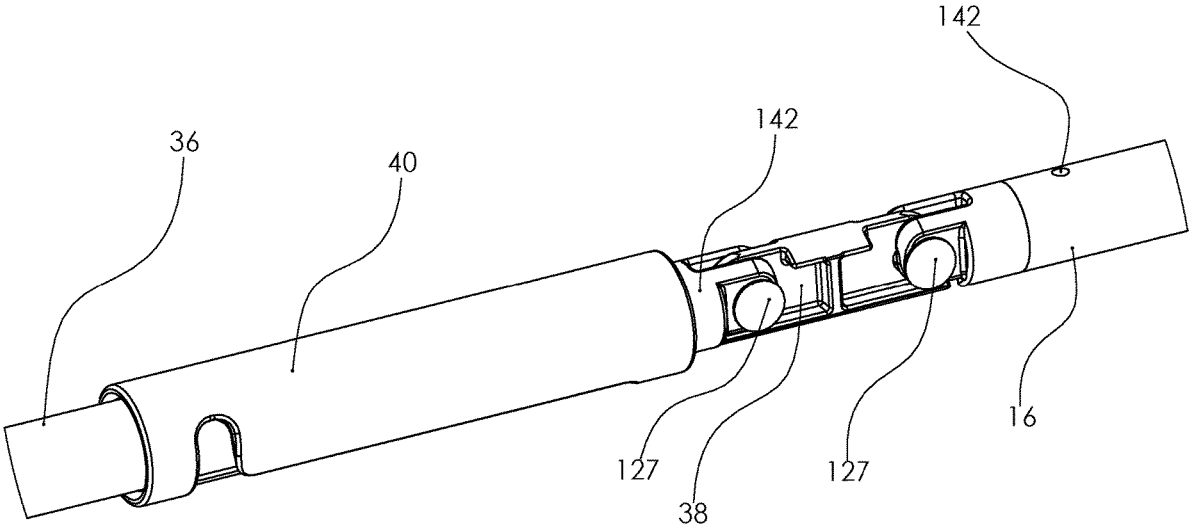
FIG. 17 shows a perspective view of one embodiment of a locking tube with upper hinge assembly with connecting plate of the present invention.
Figure 18:
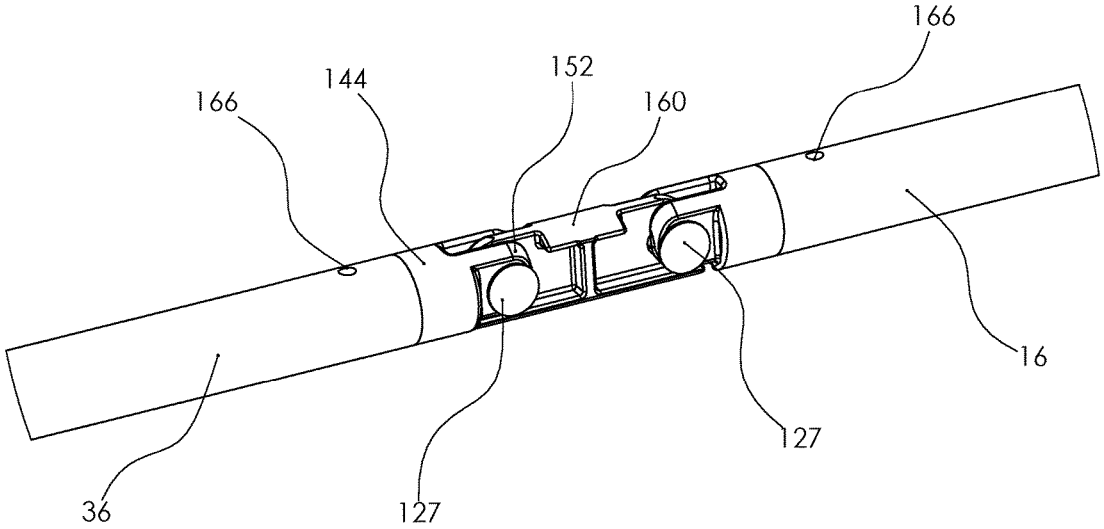
FIG. 18 shows a perspective view of one embodiment of upper hinge assembly with connecting plate of the present invention.
Figure 19:
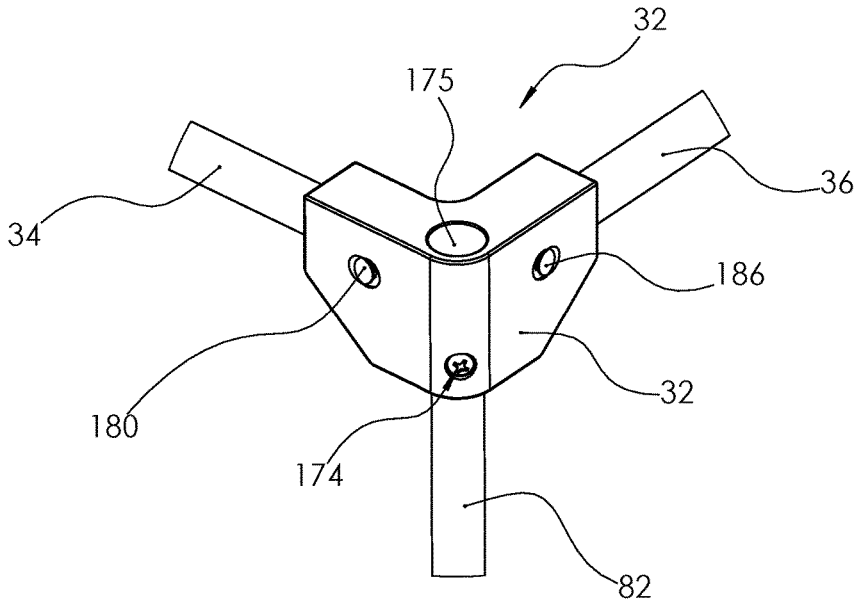
FIG. 19 shows a perspective view of one embodiment of the upper corner connector of the present invention.
Figure 20:
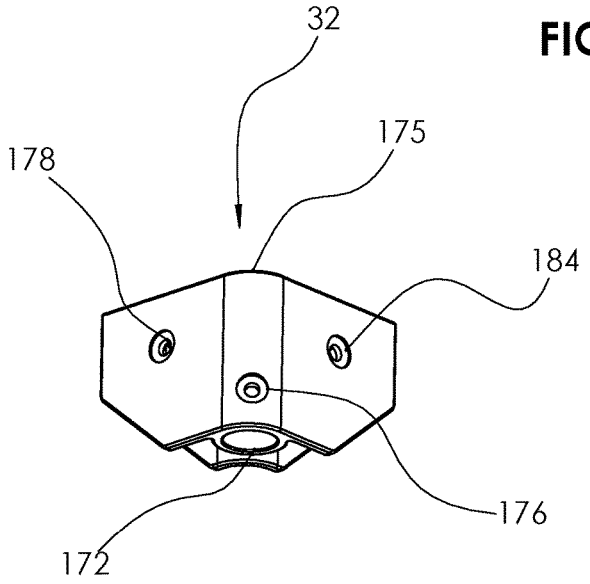
FIG. 20 shows a perspective view of one embodiment of the upper corner connector of the present invention.
Figure 21:
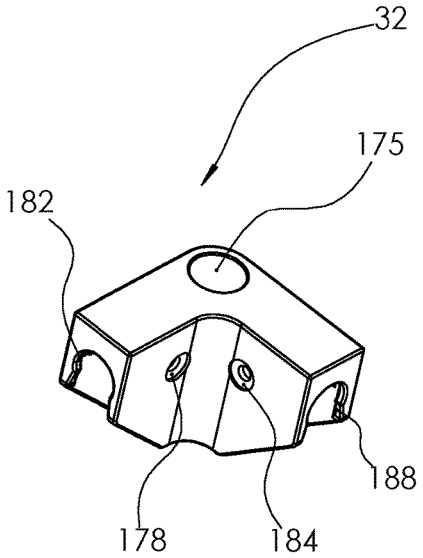
FIG. 21 shows a perspective view of one embodiment of the upper corner connector of the present invention.
Figure 22:
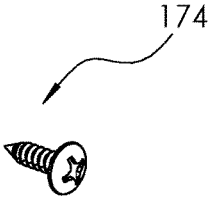
FIG. 22 shows a perspective view of one embodiment of a screw of the present invention.

The fourth corner connector 32 further comprises a fourth corner connector opening 172 to the fourth corner leg vertical tube 82 FIG. 9. The fourth corner leg screw 174 FIG. 22 inserted through the fourth corner connector 32 opening 176 through the fourth corner leg vertical tube 82 opening 190 to rigidly attach the fourth corner connector 32 to the fourth corner leg vertical tube 82. A vertical opening 175 is arranged on a top side of the fourth corner connector. The fourth corner leg 80 of another on the top embodiment can be vertically comprised through the vertical opening 190 of the lower embodiment for a secured vertical staking.

Figure 24:
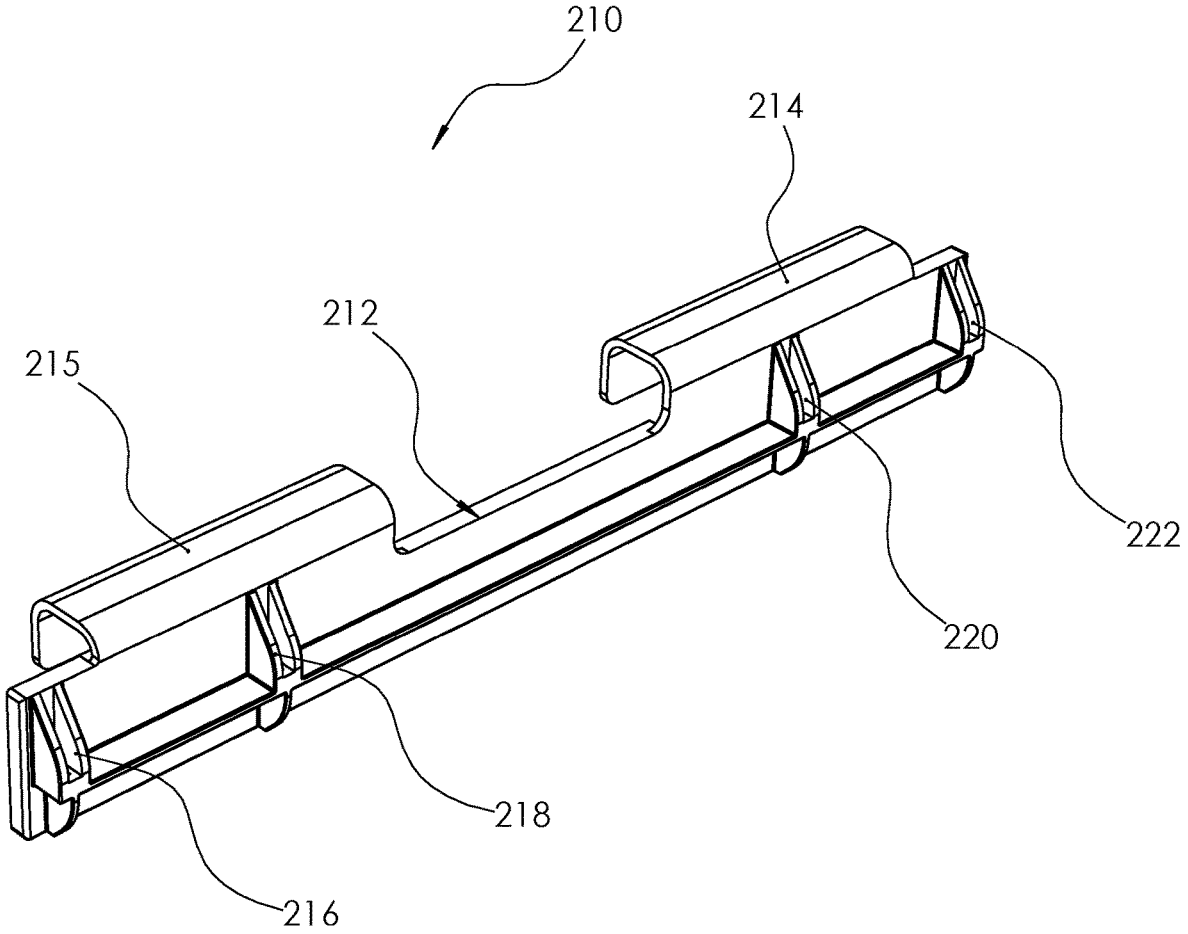
FIG. 24 shows a perspective view of one embodiment of a component of the file hanger adapter present invention
Figure 25:
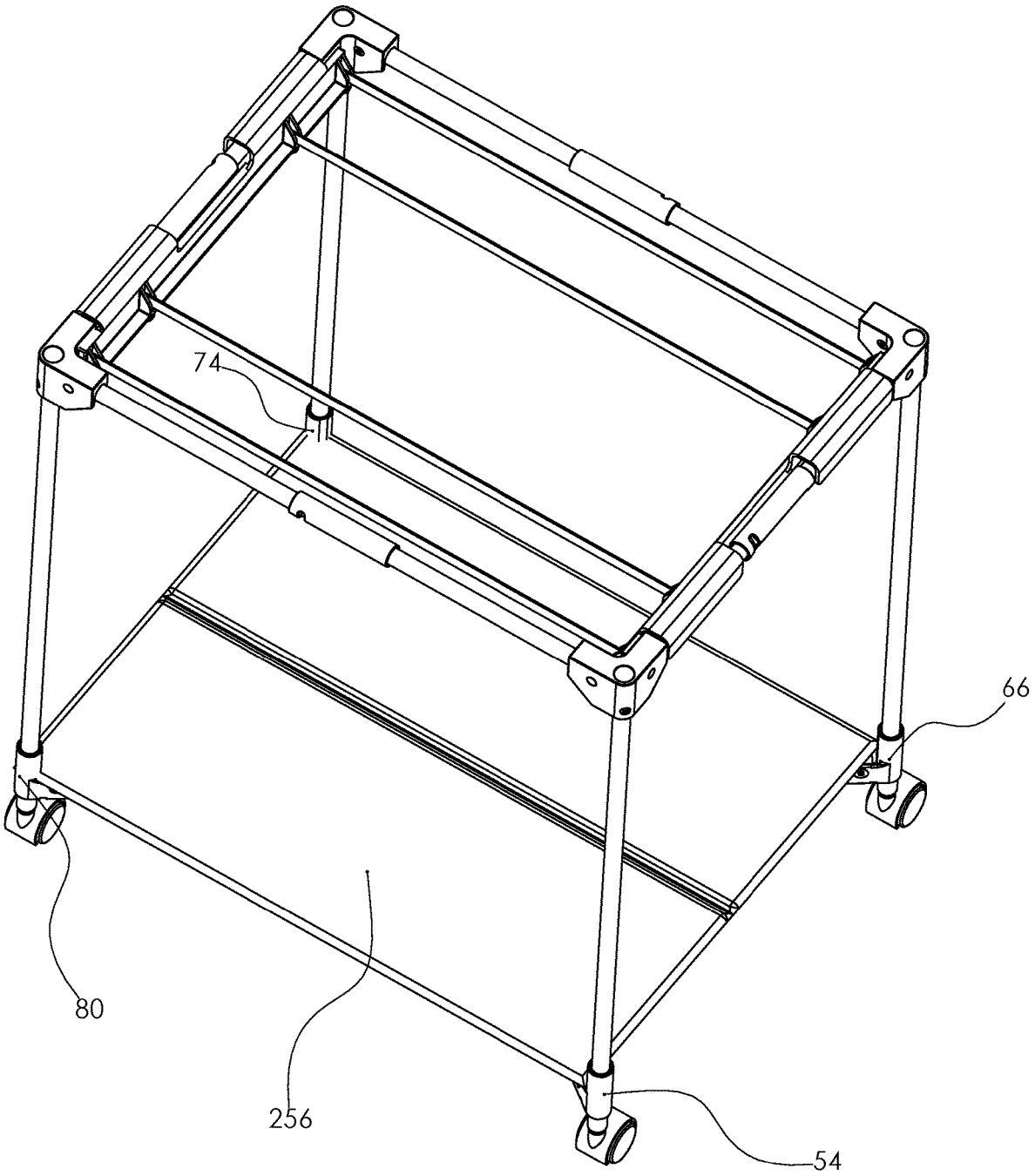
FIG. 25 shows a perspective view of one embodiment of a collapsible support structure with file hanger adapter and trolley adapter of the present invention.
Figure 26:
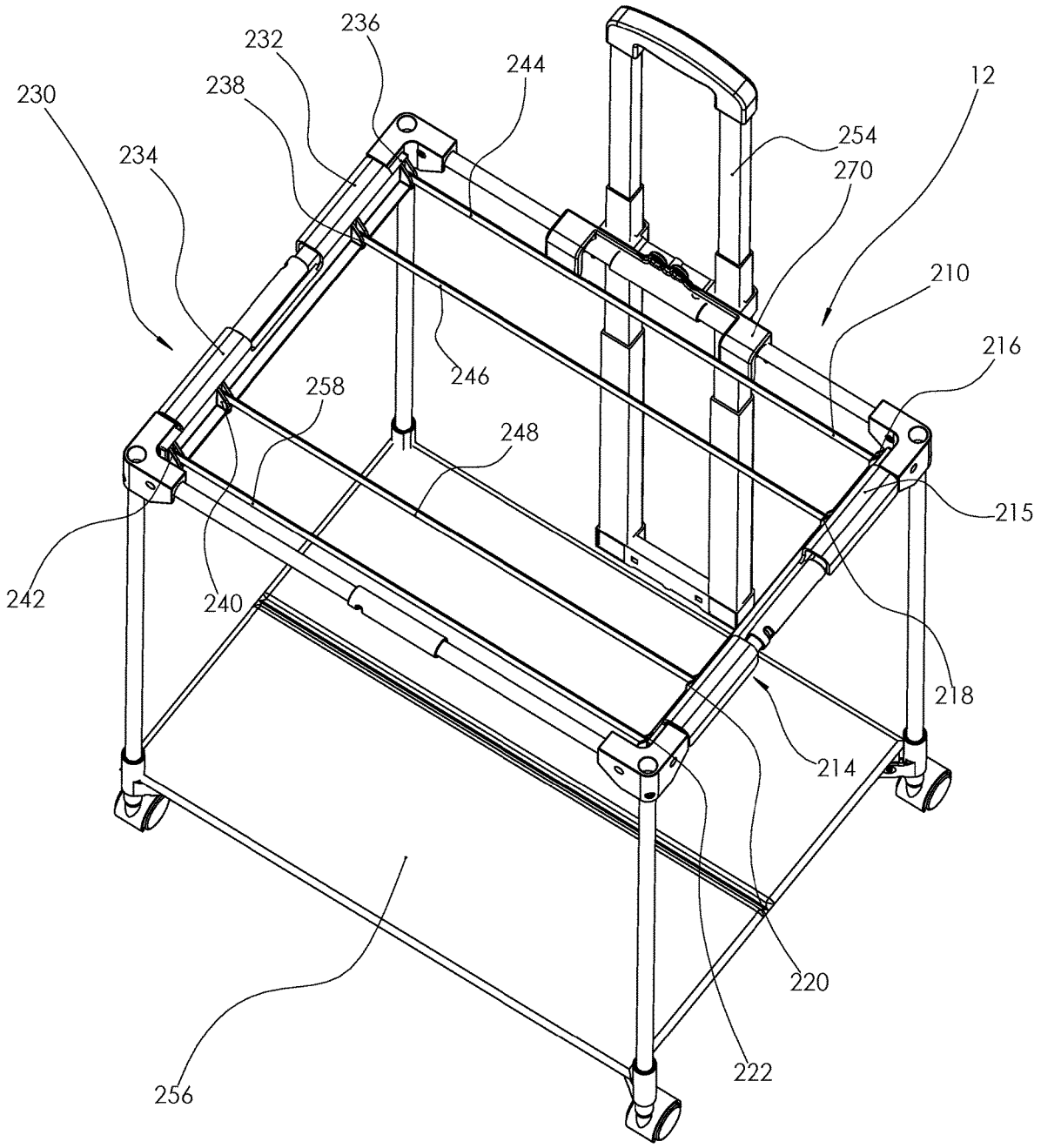
FIG. 26 shows a perspective view of one embodiment of a collapsible support structure with file hanger adapter and base support of the present invention.

Turning to FIGS. 24-26, a first connector first file hanger adaptor 210 further comprises a first brace 215 to the second connector 20 first arm 24 and further comprises the first connector first file hanger adaptor second brace 214 to the first corner connector 14 second connecting arm 18. A first connector first file hanger adaptor first segments 216, a first connector first file hanger adaptor second segment 218, a first connector first file hanger adaptor third segment 220, and a first connector first file hanger adaptor segment 222 are attached to the first central portion 212.

A second connector second file hanger adaptor 230 further comprises a first brace 232 to third corner connector 26 second connecting arm 28 and further comprises the second connector second file hanger adapter 230 second brace 234 to the fourth corner 32 first connecting arm 34. A second connector second file hanger adaptor 230 first segments 236, a second connector second file hanger adaptor second segment 238, a second connector second file hanger adaptor third segment 240, and a second connector second file hanger adaptor fourth segment 242 are attached to the first central portion 212.

A first lateral support member 244 is arranged between the first connector first file hanger adaptor first segments 216 and the second connector second file hanger adaptor first segments 236. A second lateral support member 246 is arranged between the first connector first file hanger adaptor second segment 218 and the second connector second file hanger adaptor second segment 238. A third lateral support member 248 is arranged between the first connector first file hanger adaptor third segment 220 and the second connector second file hanger adaptor third segment 240. A fourth lateral support member 258 is arranged between the first connector first file hanger adaptor fourth segment 222 and the second connector second file hanger adaptor fourth segments 242.

Figure 25A:
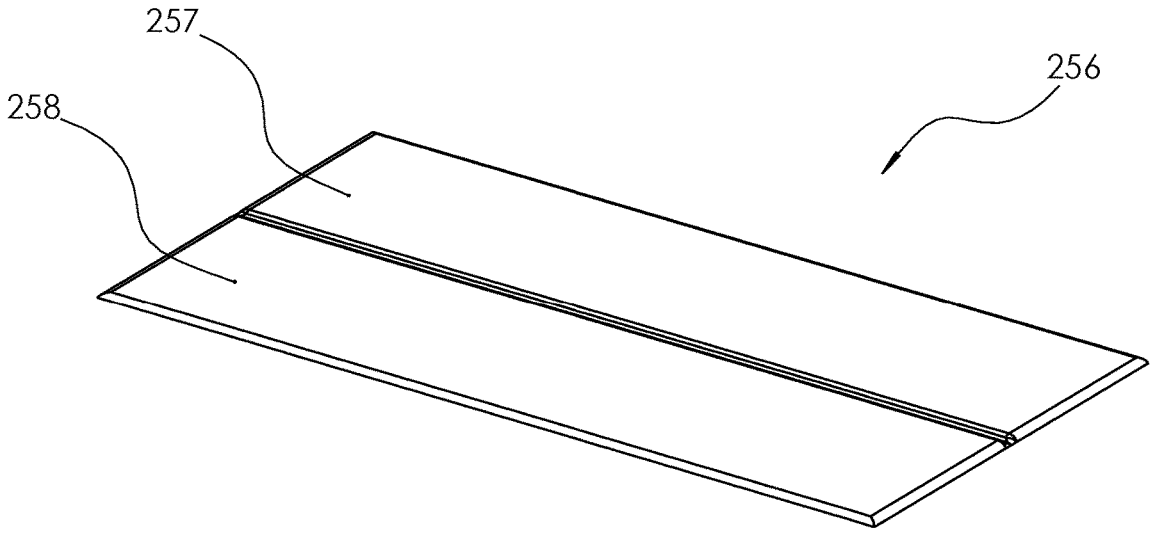
Figure 25B:
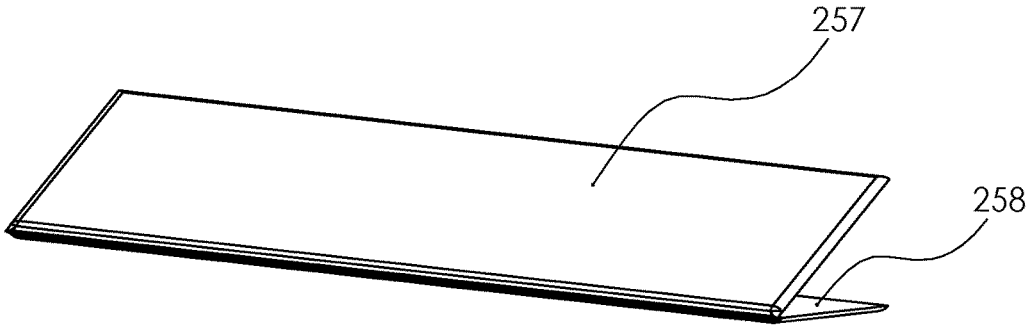

FIGS. 25, 25A and 25B illustrate the first design of a portable folding base member 256 that rests upon the central support assembly 110 between the first leg slider 54, the second leg slider 66, the third leg slider 74 and the fourth leg slider 80.

Figure 27:
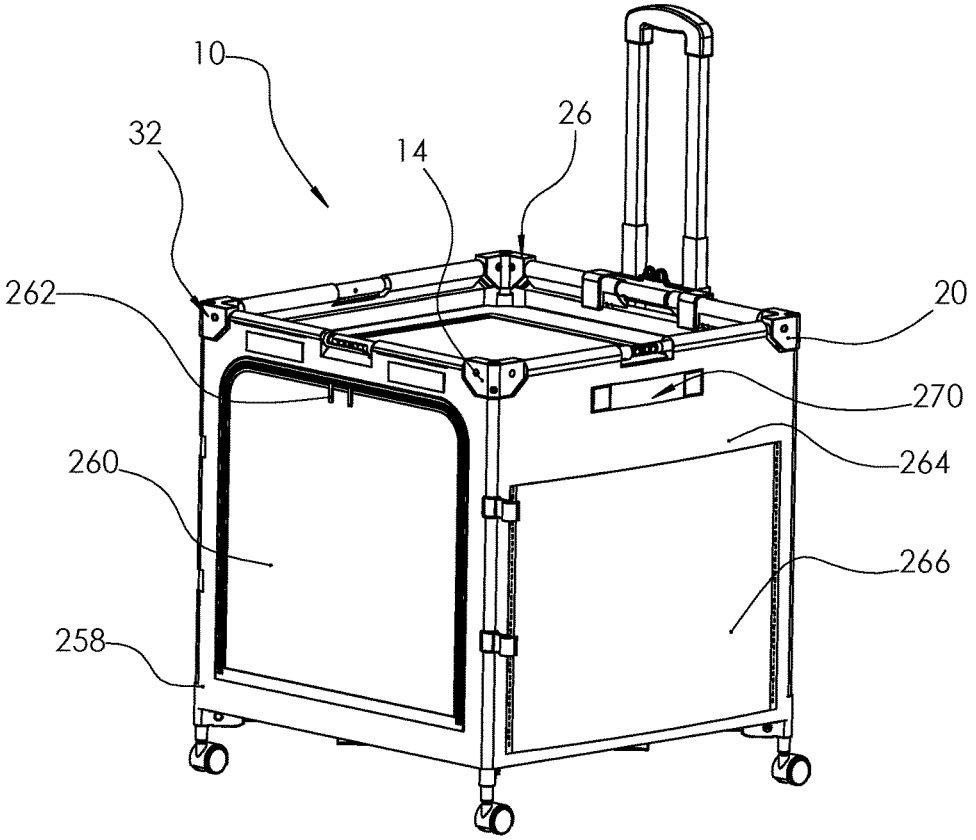
FIG. 27 shows a perspective view of one embodiment with exterior fabrics pockets, and telescopic handle of the present invention.
Figure 28:
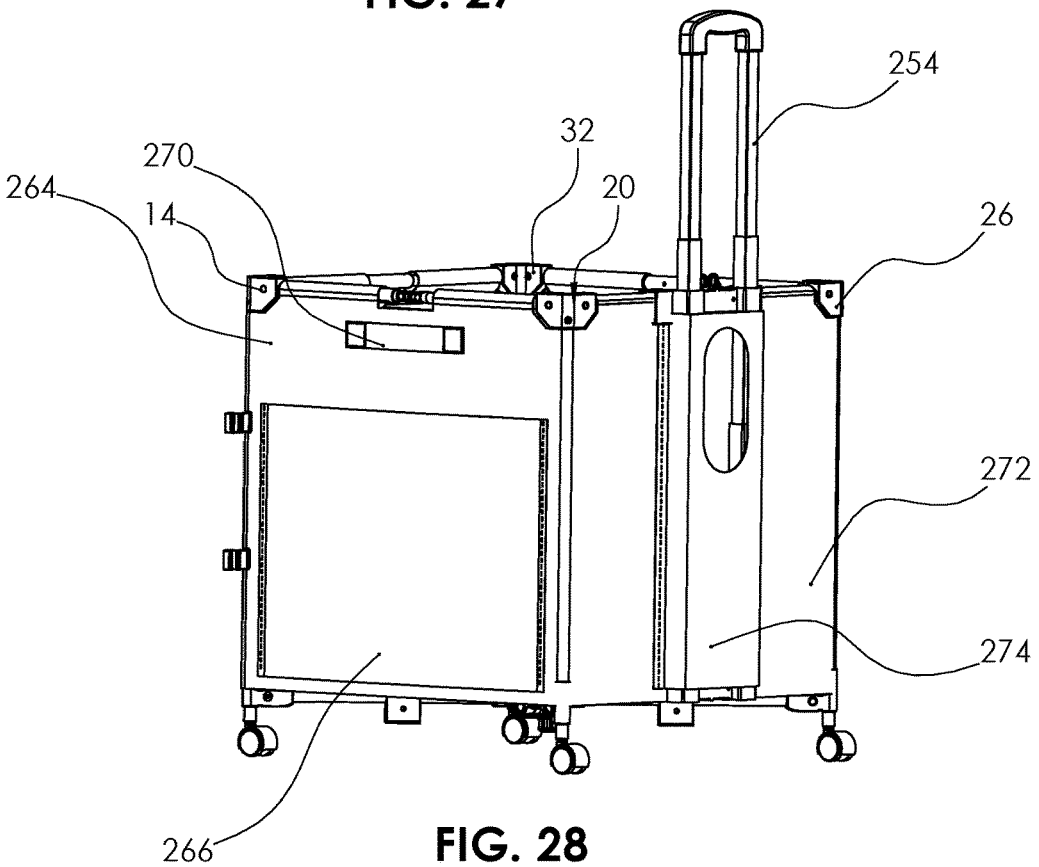
FIG. 28 shows a perspective view of one embodiment with exterior fabrics pockets, and telescopic handle of the present invention.
Figure 29:
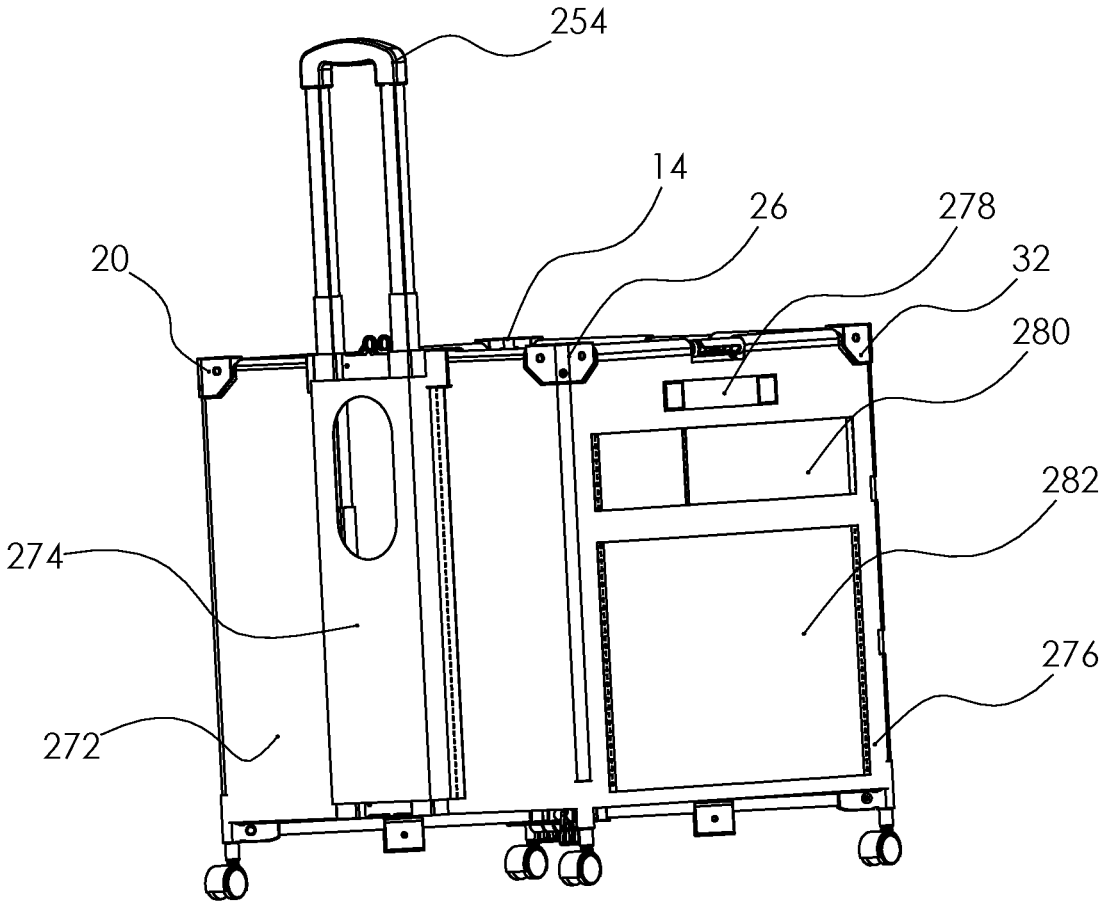
FIG. 29 shows a perspective view of one embodiment with exterior fabrics pockets, and telescopic handle assembly of the present invention.

As shown in FIGS. 27-29, a first panel 258 as the front panel in the embodiment is arranged between the first corner connector 14 and the fourth corner connector 32. The first panel 258 further comprises a first panel window 260 which can be opened or closed with a first panel window zipper 262. A second panel 264 is arranged between the first corner connector 14 and the second corner connector 20. The second panel 264 further comprises a second panel pocket 266 with or without a zipper along with a second panel handle 270. A third panel 272 is arranged between the second corner connector 20 and the third corner connector 26. The third panel 272 further comprises a third panel pocket 274 which can accommodate the telescoping handle 254. A fourth panel 276 FIG. 29 is arranged between the third corner connector 26 and the fourth corner connector 32. The fourth panel 276 further comprises a fourth panel handle 278, a fourth panel upper pockets 280 and a fourth panel lower pocket 282 with or without zipper.

Figure 30:
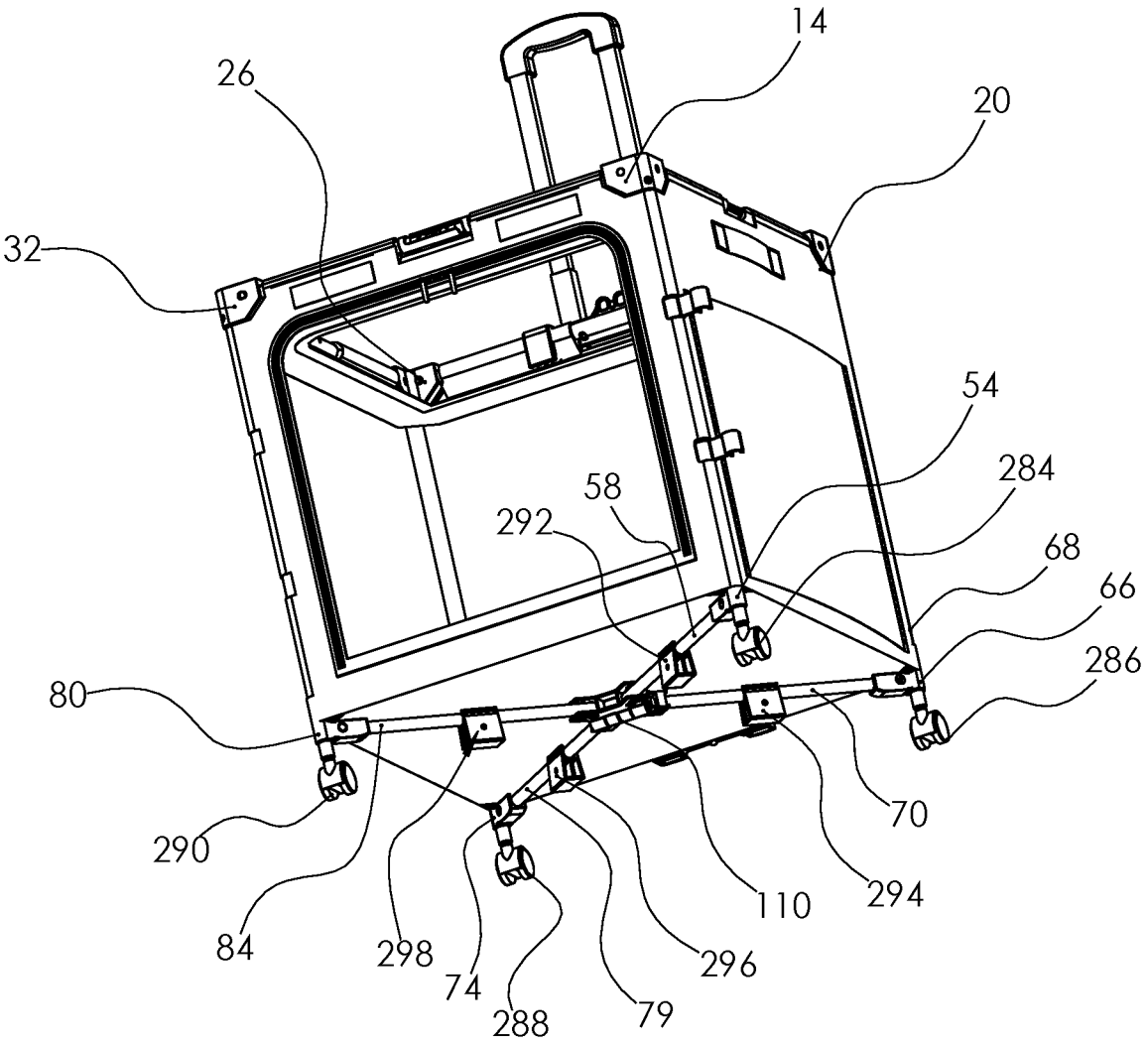
FIG. 30 shows a perspective view of one embodiment with exterior fabrics, pockets, and zipper on the front and the top of the present invention.

FIG. 30 In all embodiments the first leg 54 is connected to a first wheel 284. The second leg 66 is attached to a second wheel 286. The third leg 74 is attached to a third wheel 288. The fourth leg 80 is attached to a fourth wheel 290. In some embodiments for additional support, first central support block 292 can be attached to the first lower arm 58. The second central support block 294 can be attached to the second lower arm 70. The third central support block 296 can be attached to the third lower arm 79. The fourth central support block 298 can be attached to the fourth lower arm 84.

Figure 31:
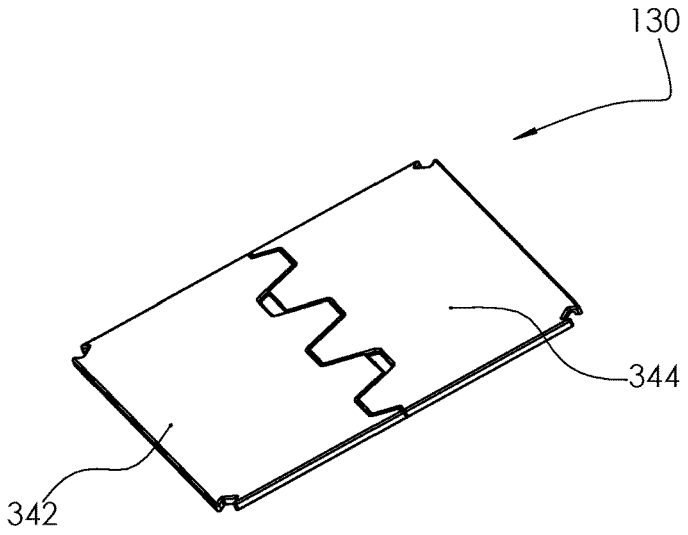
FIG. 31 shows a perspective view of one embodiment with supporting second base design of the present invention.
Figure 32:
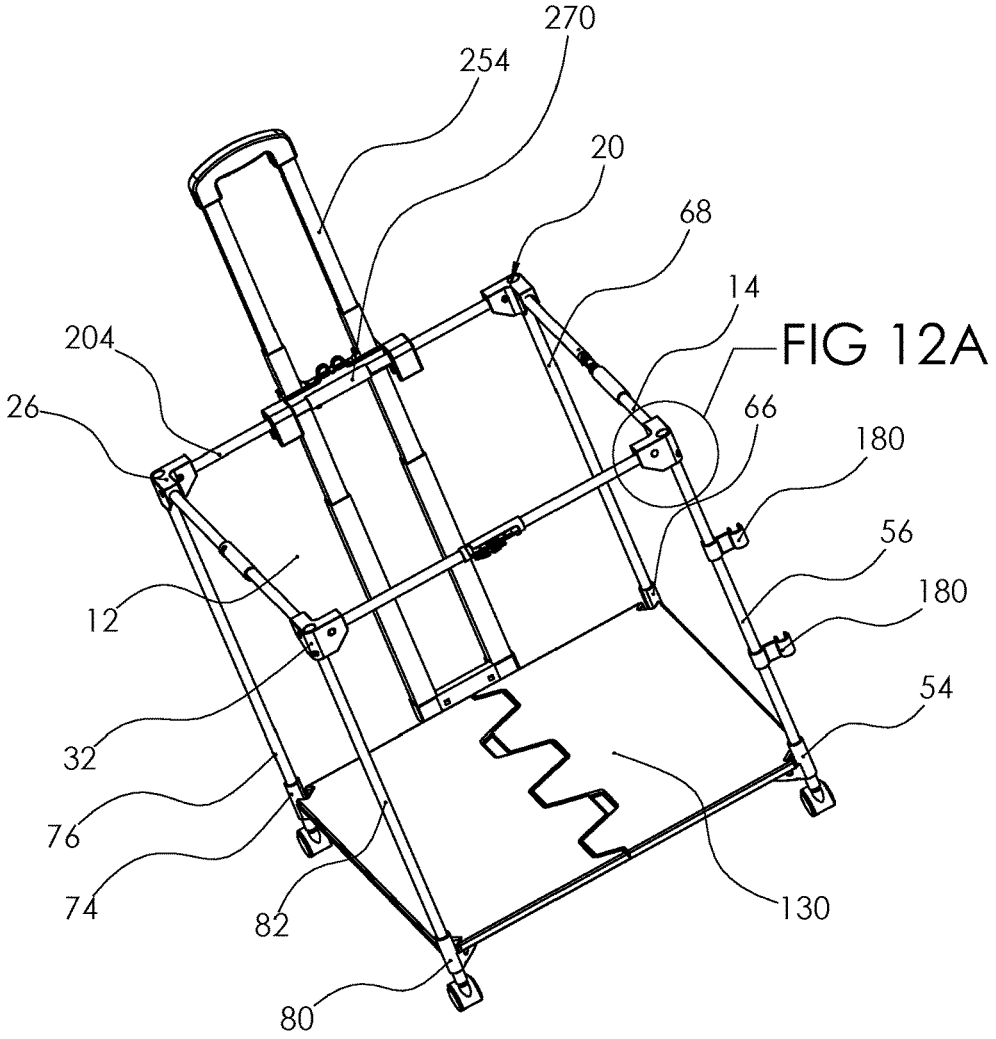
FIG. 32 shows a perspective view of one embodiment with supporting second base design and telescopic handle assembly of the present invention.

Turning to FIG. 31 and FIG. 32 The second base assembly design 130 further comprises of a first base component engaged to a second base component. The removable base assembly 130 is further comprises two foldable panels 342 and 344 to rest upon a central support assembly 110 between the first leg 54, the second leg 66, third leg 74 and the leg 80.

Figure 33:
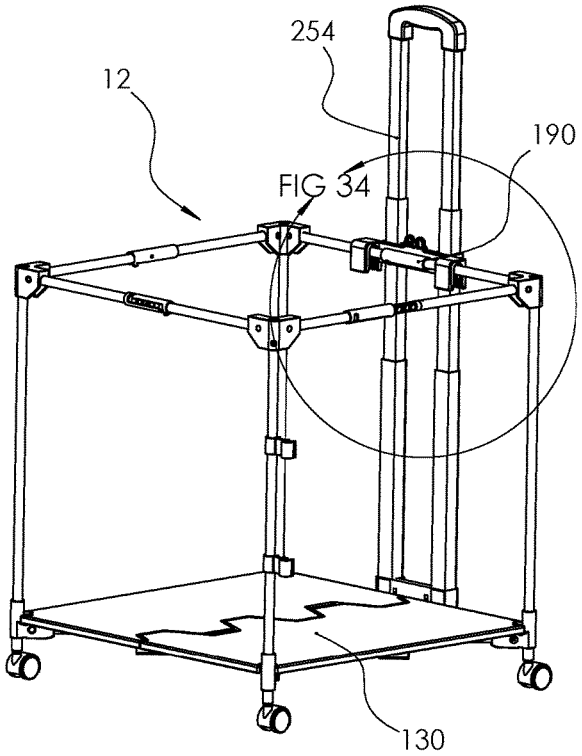
FIG. 33 shows a perspective view of one embodiment with supporting second base design and telescopic handle assembly of the present invention.
Figure 34:
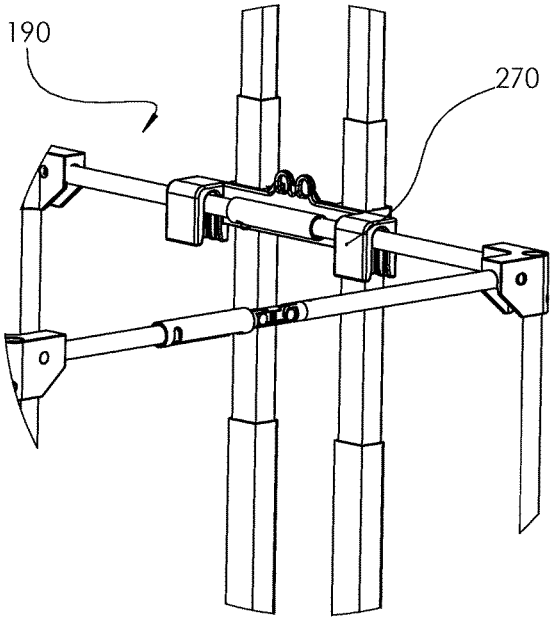
FIG. 34 shows a detail view of one embodiment with telescopic handle adapter assembly of the present invention.
Figure 35:
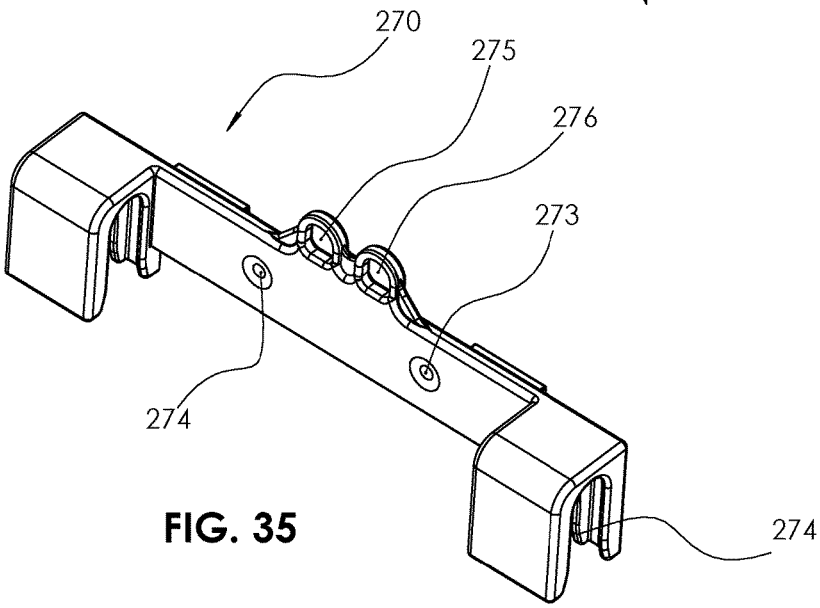
FIG. 35 shows a detail view of one embodiment with telescopic handle adapter detail of the present invention.

Turning to FIG. 33-35 A telescoping handle connector adapter 270 is joined to the collapsible support structure 12. The telescoping handle connector adapter 270 is connected to a telescoping handle 254 can be comprise on the side of the structure 12 temporarily on demand. The on demand removable comprising telescopic adaptor 270 which is joined to the handle 254 using rivets 126 through openings 273 and 274. The telescopic adaptor 270 is temporary compressed to two of the connector arms in the upper structure 12. A bungee cord two ends pass through the telescoping handle connector adaptor 270 first opening 275 and second opening 276 to be comprised together in the back of adaptor 270.

FIGS. 36-37 depicts storage unit containers stacked on top of each other comprise top container 1500 first leg connector 54 inside lower container 1600 first upper corner connector 14 opening 180 to secure vertical stacking. Comprise top container 1500 second leg connector 66 inside lower container 1600 second upper corner connector 20 opening 180 to secure vertical stacking. Comprise top container 1500 third leg 74 inside lower container 1600 third upper corner connector 26 opening 180 to secure vertical stacking. Comprise top container 1500 fourth leg 80 inside lower container 1600 fourth upper corner connector 32 opening 180 to secure vertical stacking.

Figure 38:
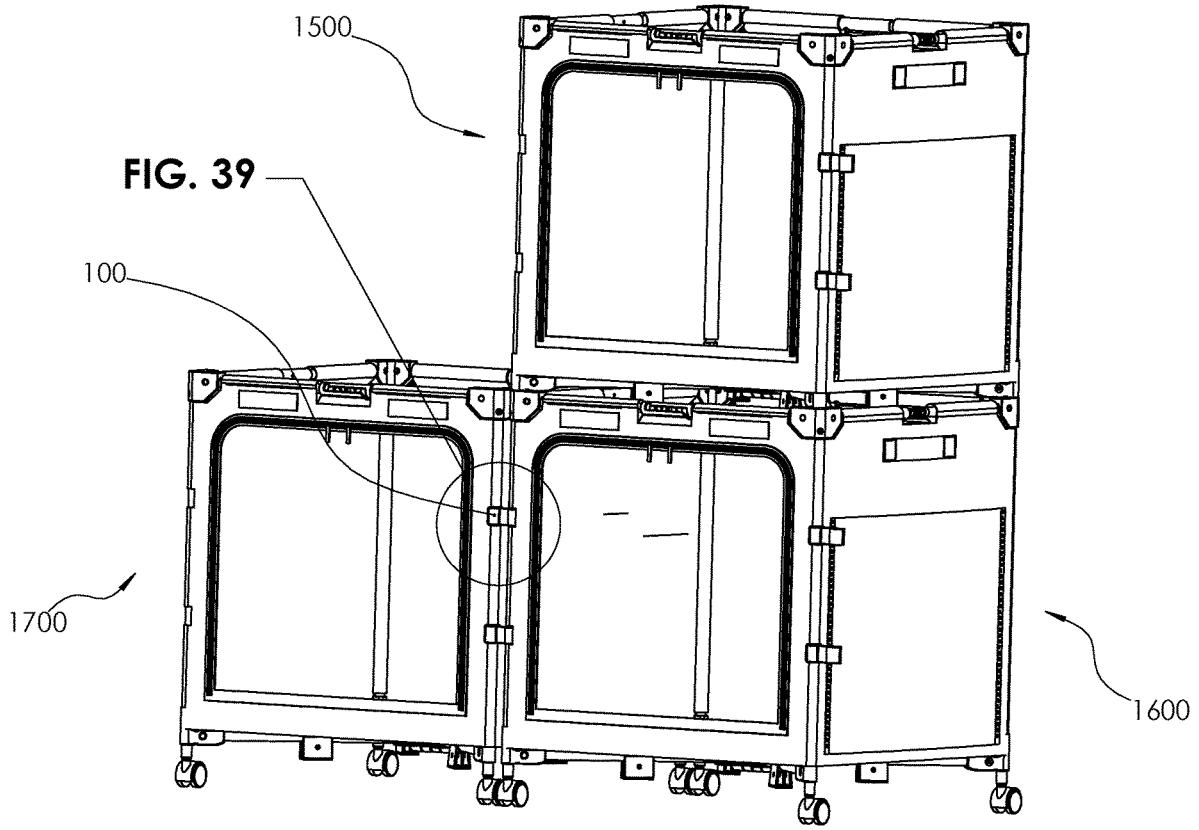
FIG. 38 shows a perspective view of vertical and horizontal stacking of three embodiments base assembly design of the present invention.
Figure 39:
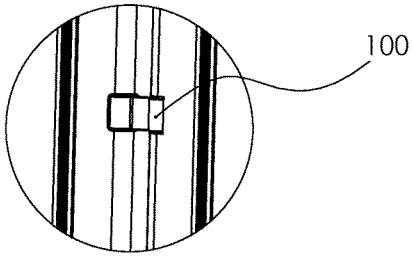
FIG. 39 shows a perspective view of detail horizontal stacking of two embodiments base assembly design of the present invention.
Figure 40:
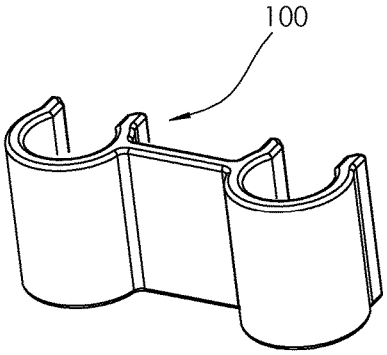
FIG. 40 shows a perspective view of a horizontal stacking clip of the present invention.
Figure 41:
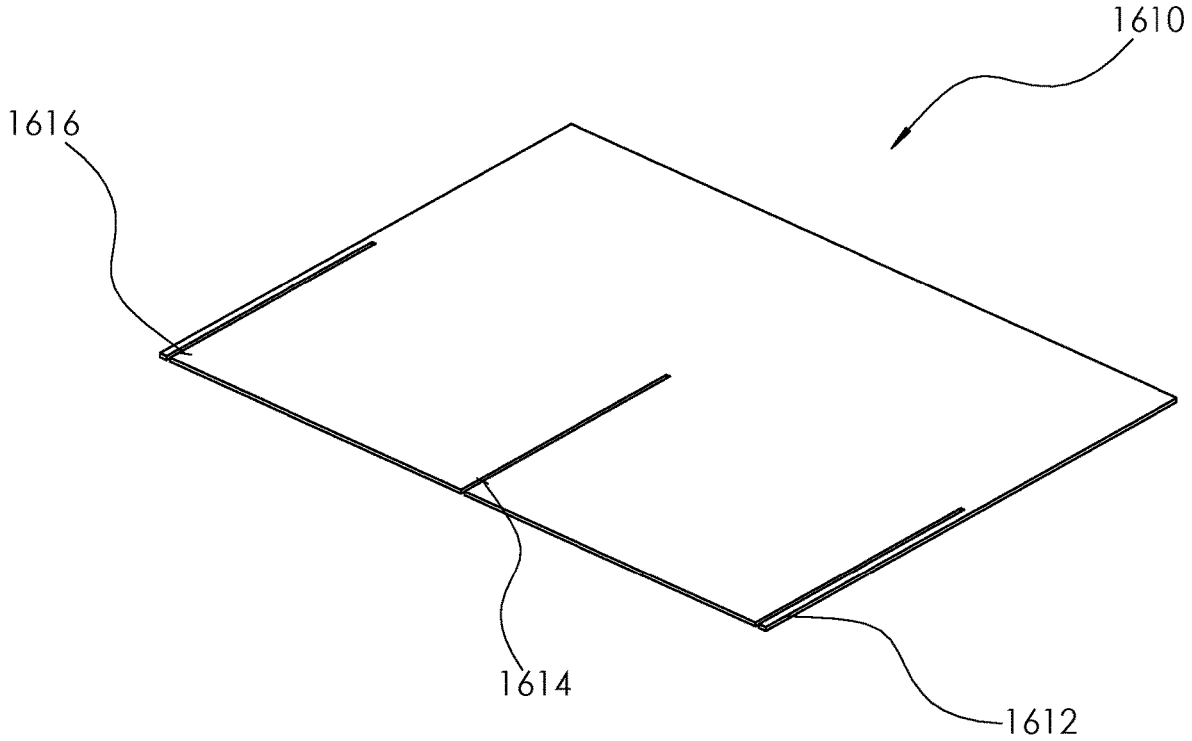
FIG. 41 shows a perspective view of one embodiment of the first single shelve assembly configuration of the present invention.
Figure 42:
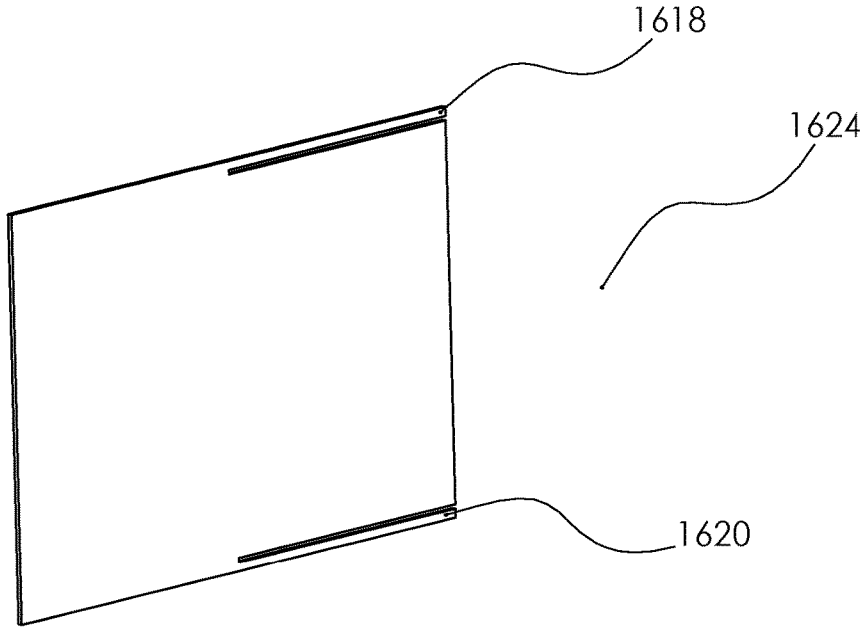
FIG. 42 shows a perspective view of one embodiment of the second single shelve assembly configuration of the present invention.
Figure 43:
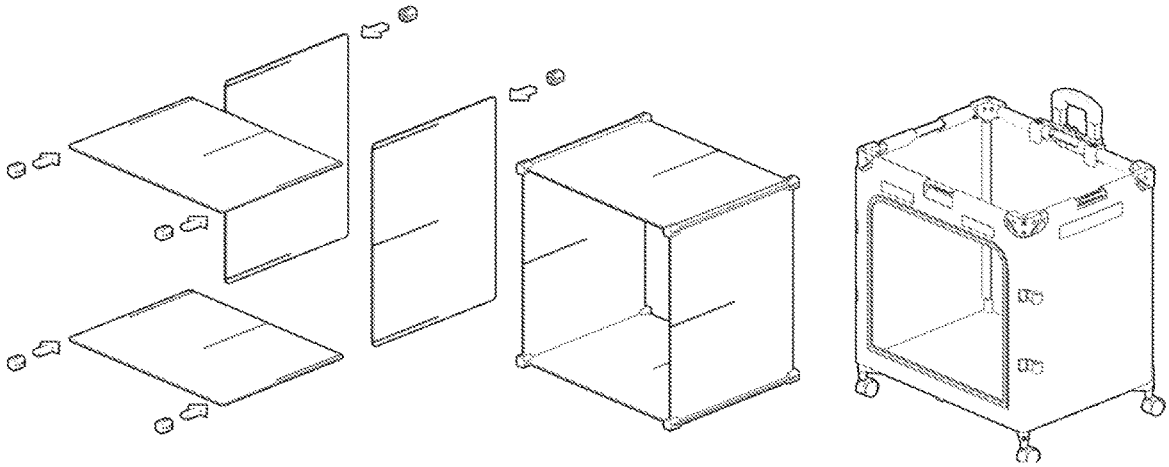
FIG. 43 shows a detail view of one embodiment of first shelves assembly configuration of the present invention.
Figure 44:
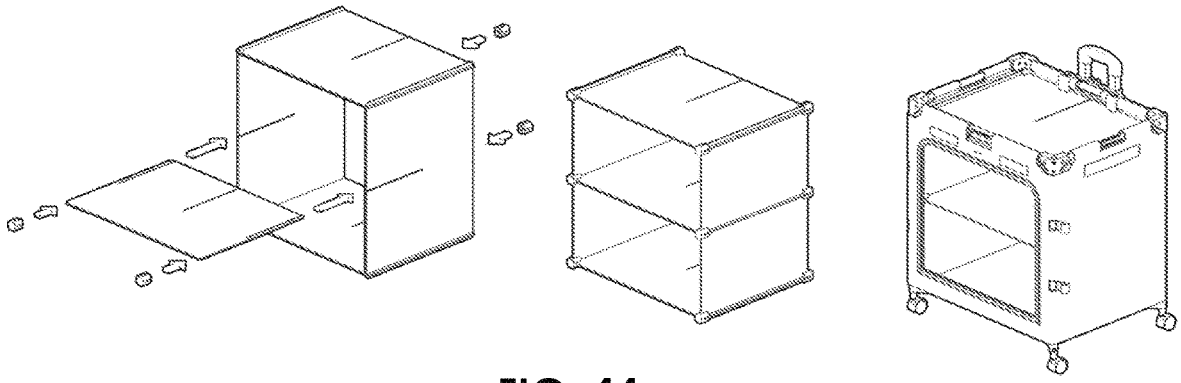
FIG. 44 shows a detail view of one embodiment of second shelves assembly configuration of the present invention.
Figure 45:
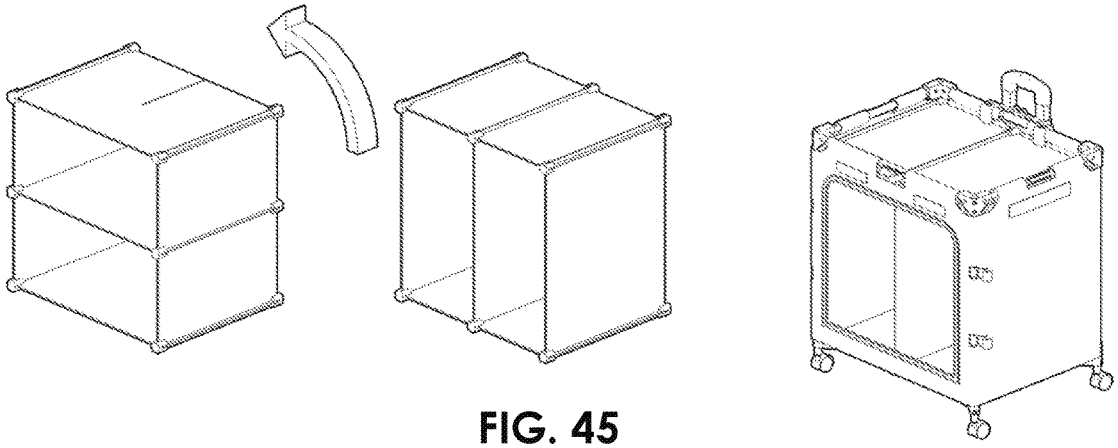
FIG. 45 shows a detail view of one embodiment of third shelves assembly configuration of the present invention.
Figure 46:
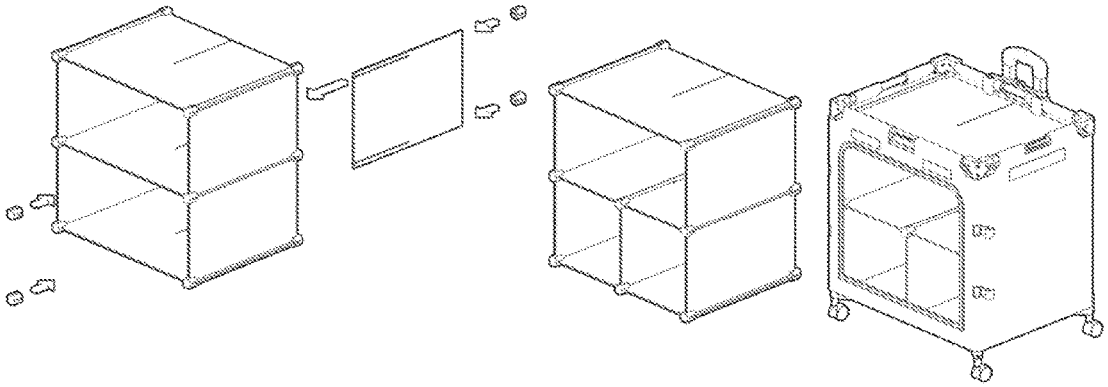
FIG. 46 shows a detail view of one embodiment of fourth shelves assembly configuration of the present invention
Figure 47:
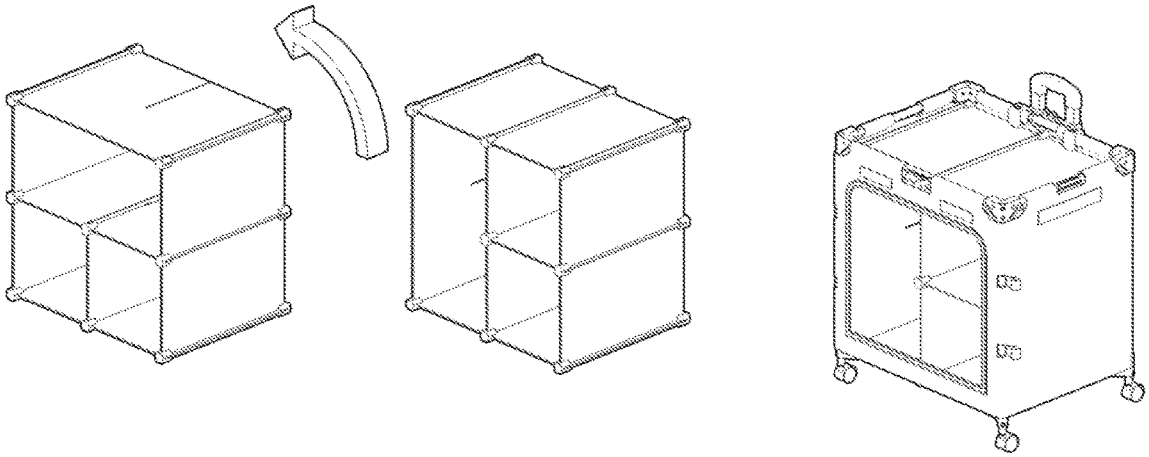
FIG. 47 shows a detail view of one embodiment of fifth shelves assembly configuration of the present invention.
Figure 48:
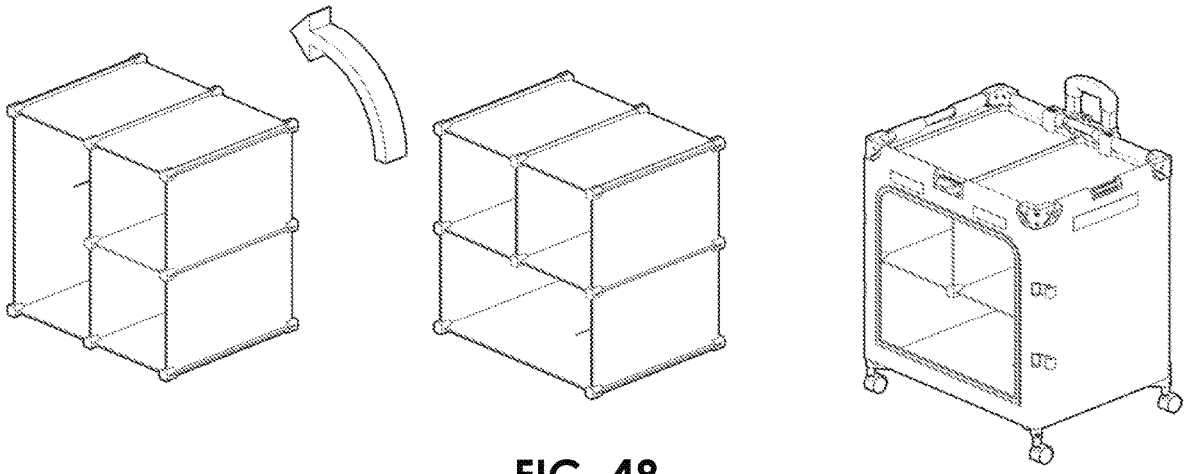
FIG. 48 shows a detail view of one embodiment of sixth shelves assembly configuration of the present invention.
Figure 49:
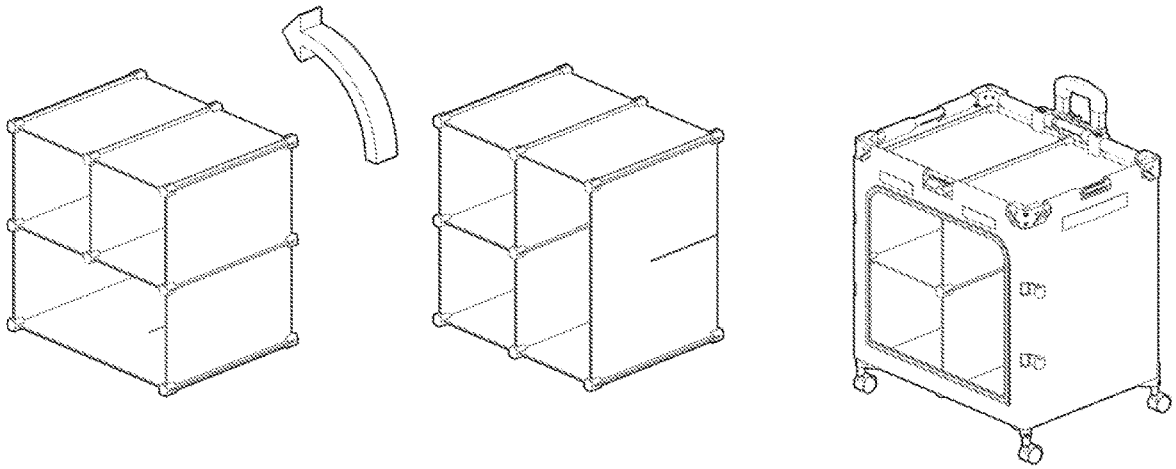
FIG. 49 shows a detail view of one embodiment of seventh shelves assembly configuration of the present invention.
Figure 50:
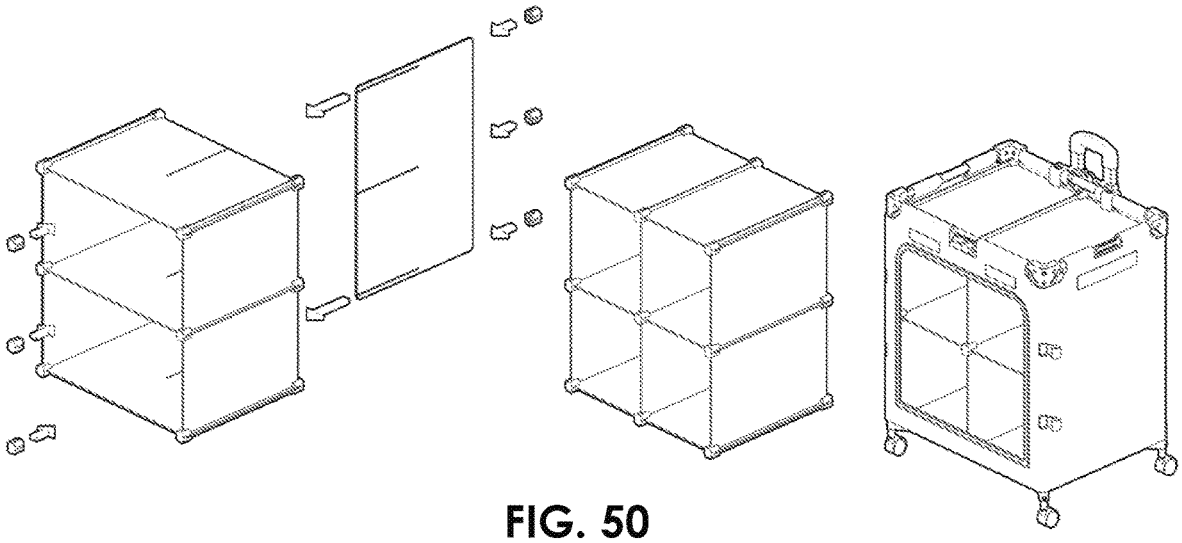
FIG. 50 shows a detail view of one embodiment of eights shelves assembly configuration of the present invention.

FIG. 38-40 describe storage unit's container horizontal stacking next to each other by compressing clip 100 to hold the two containers together.

FIG. 41-50 A total of six shelving unit 1610 comprises first slot 1612 and second slot 1614 and third slot 1616. A one unit of shelving unit 1624 of comprises first slot 1618 and second slot 1620. Comprising 4 shelfs of 1610 by aligning and comprising first slot 1612 and second slot 1614 and third slot 1616 of one shelve to another shelve to create 4 sides even walls cube, configuration 1 as in FIG. 43. Inserting and comprising one more shelving of 1610 by aligning and comprising first slots 1612 and third slot 1616 creates configuration 2 of horizontal shelving as in FIG. 44. By rotating the whole assembly 90 degrees counter clock, the horizontal shelving rotates to a vertical shelving creates configuration 3 as in FIG. 45. Inserting and comprising one shelving 1624 first slot 1618 and second slot 1620 to the horizontal shelf creates configuration 4 as in FIG. 46. By rotating the whole assembly in FIG. 46 by 90 degrees counter clock, we generate configuration 5 as in FIG. 47. By rotating the whole assembly in FIG. 47 by 90 degrees counter clock, we generate configuration 6 as in FIG. 48. By rotating the whole assembly in FIG. 48 by 90 degrees counter clock, we generate configuration 7 as in FIG. 49. By Removing shelving 1624 from assembly and inserting shelving 1612, we generate configuration 8 as in FIG. 50.

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A collapsible support structure for a container assembly;

the collapsible support structure comprising:

a first corner connector, rotationally connected to a second corner connector with a second connector plate;

a first leg, fixed to the first corner connector;

a first leg lower arm, joined to the first leg and a first central support member;

a second leg, fixed to the second corner connector;

a second leg lower arm, joined to the second leg and the first central support member;

a third corner connector, rotationally connected to the second corner connector with a third connector plate;

a fourth corner connector, rotationally connected to the third corner connector with a fourth connector plate; and rotationally connected to the first corner connector with a first connector plate;

a third leg, fixed to the third corner connector;

a third leg lower arm, joined to the third leg and a second central support member;

a fourth leg fixed to the fourth corner connector;

a fourth leg lower arm, joined to the fourth leg and the second central support member;

a collapsible flexible box body, arranged around the collapsible support structure with a front wall, a left sidewall, a right sidewall, a back sidewall, and a bottom wall, wherein the front wall includes an access port;

a central support assembly further comprising the first central support member rotationally joined to the second central support member with a pin; wherein, the central support assembly is configured to be located at a geometric center of the bottom wall; wherein the central support assembly rotates about a central axis of the pin;

a first lower arm tube is pivotally connected and arranged to vertically rotate along the first leg and horizontally rotate along the central support assembly;

a second lower arm tube is pivotally connected and arranged to vertically rotate along the second leg and horizontally rotate along the central support assembly;

a third lower arm tube is pivotally connected and arranged to vertically rotate along the third leg and horizontally rotate along the central support assembly;

a fourth lower arm tube is pivotally connected and arranged to vertically rotate along the fourth leg and horizontally rotate along the central support assembly;

a locking assembly, configured to lock and prevent collapse of the connector plates; the locking assembly comprising:

a first arm locking tube configured to slide over the first connector plate;

a second arm locking tube configured to slide over the second connector plate;

a third arm locking arm tube configured to slide over the third connector plate; and a fourth arm locking arm tube configured to slide over the fourth connector plate.

2. The collapsible storage and transportation box of claim 1, further comprising:

a first vertical arm, attached to the first corner connector and slidably engaged with the first leg;

a second vertical arm, attached to the second corner connector and slidably engaged with the second leg;

a third vertical arm, attached to the third corner connector and slidably engaged with the third leg;

a fourth vertical arm, attached to the fourth corner connector and slidably engaged with the fourth leg.

3. The collapsible storage and transportation box of claim 2, further comprising: a vertical opening, arranged on a top side of the fourth corner connector; wherein a second collapsible storage and transportation box fourth corner leg vertical tube travels through the vertical opening in order to join the collapsible support structure to a second collapsible storage and transportation box.

4. The collapsible storage and transportation box of claim 3, further comprising a clip attached to the fourth corner leg vertical tube to join the collapsible storage and transportation box to another collapsible storage and transportation box.

5. The collapsible storage and transportation box of claim 4, further comprising a file hanging assembly, joined to the collapsible support structure and further comprising:

a first connector first file hanger adaptor further comprising:

a first brace, joined to the second connector first arm and further comprising:

a first connector first file hanger adaptor second brace, joined to the first corner connector second connecting arm;

a first connector first file hanger adaptor first segment, attached to the first central portion a first connector first file hanger adaptor second segment, attached to the first central portion a first connector first file hanger adaptor third segment, attached to the first central portion; and a first connector first file hanger adaptor fourth segment, attached to the first central portion;

a second connector second file hanger adaptor further comprising:

a first brace, joined to third corner connector second connecting arm and further comprising:

a second connector second file hanger adapter second brace joined to the fourth corner first connecting arm;

a second connector second file hanger adaptor first segment, attached to the first central portion a second connector second file hanger adaptor second segment, attached to the first central portion a second connector second file hanger adaptor third segment, attached to the first central portion, and a second connector second file hanger adaptor fourth segment, attached to the first central portion a first lateral support member, arranged between the first connector first file hanger adaptor first segment and the second connector second file hanger adaptor first segments, a second lateral support member, arranged between the first connector first file hanger adaptor second segment and the second connector second file hanger adaptor second segment;

a third lateral support member, arranged between the first connector first file hanger adaptor third segment and the second connector second file hanger adaptor third segment;

a fourth lateral support member, arranged between the first connector first file hanger adaptor fourth segment and the second connector second file hanger adaptor fourth segment.

6. The collapsible storage and transportation box of claim 5, further comprising a removable base assembly, upon the central support assembly between the first leg, the second leg, the third leg, and the fourth leg 80.

7. The collapsible storage and transportation box of claim 6, wherein the removable base assembly further comprises two foldable panels.

8. The collapsible storage and transportation box of claim 7, further comprising a shelving unit arranged within the collapsible; the shelving unit comprising:

a first shelf having: a first shelf first slot, a first shelf second slot and a first shelf third slot;

a second shelf further comprises a second shelf first slot and second shelf second slot;

wherein mating the first shelf with the second shelf compartmentalizes the collapsible flexible box body.

* * * * *